US012342971B2

(12) United States Patent
Truong et al.

(10) Patent No.: US 12,342,971 B2
(45) Date of Patent: Jul. 1, 2025

(54) SCRUBBER DEVICE AND CLEANSING SYSTEM

(71) Applicant: Sud Scrub Inc., San Gabriel, CA (US)

(72) Inventors: Raymond Truong, Las Vegas, NV (US); Steven Truong, Las Vegas, NV (US)

(73) Assignee: Sud Scrub Inc., San Gabriel, CA (US)

( * ) Notice: Subject to any disclaimer, the term of this patent is extended or adjusted under 35 U.S.C. 154(b) by 0 days.

(21) Appl. No.: 18/401,216

(22) Filed: Dec. 29, 2023

(65) Prior Publication Data

US 2024/0130576 A1 Apr. 25, 2024

Related U.S. Application Data

(63) Continuation of application No. 18/320,131, filed on May 18, 2023, now Pat. No. 11,910,970.

(60) Provisional application No. 63/370,873, filed on Aug. 9, 2022.

(51) Int. Cl.
*A47K 7/02* (2006.01)

(52) U.S. Cl.
CPC ..... *A47K 7/02* (2013.01); *A45D 2200/1009* (2013.01)

(58) Field of Classification Search
CPC ..... A46B 1/00; A46B 3/04; A46B 5/0025; A46B 5/0029; A46B 5/04; A46B 9/005; A46B 9/023; A46B 9/0025; A46B 2200/102; A47K 7/02
USPC ..... 15/160, 187, 188; D4/126, 128; D28/63
See application file for complete search history.

(56) References Cited

U.S. PATENT DOCUMENTS

| | | | |
|---|---|---|---|
| 2,075,229 | A | 3/1937 | James |
| 2,156,514 | A | 5/1939 | Joseph |
| 2,682,675 | A | 7/1954 | Frank |
| 2,958,889 | A | 11/1960 | Greenblatt |

(Continued)

FOREIGN PATENT DOCUMENTS

| | | |
|---|---|---|
| CN | 305084175 | 3/2019 |
| CN | 306692372 | 7/2021 |

(Continued)

OTHER PUBLICATIONS

First Office Action for Chinese Application No. 202430009806.1, mailed Apr. 24, 2024, 1 page.

(Continued)

*Primary Examiner* — Tom Rodgers
(74) *Attorney, Agent, or Firm* — Perkins Coie, LLP

(57) ABSTRACT

A device includes a central body having an array of scrubbing features that extend away from a first surface of the central body. The array of scrubbing features is arranged in wave-shaped pathways extending radially from a first end of the pathways at an interior of the central body toward a second end of the pathways at a periphery of the central body. The array of scrubbing features includes a first set of scrubbing features extending a first height away from the first surface and a second set of scrubbing features extending a second height away from the first surface. The device has a unitary structure made of silicone and infused with an antimicrobial agent. The device is configured to be more durable and have a longer use time than conventional bath and shower devices thereby mitigating climate change.

20 Claims, 20 Drawing Sheets

(56) References Cited

U.S. PATENT DOCUMENTS

| | | | |
|---|---|---|---|
| 4,154,883 | A | 5/1979 | Elias |
| D290,576 | S | 6/1987 | Bird et al. |
| 5,054,246 | A | 10/1991 | Phaal et al. |
| D332,841 | S | 1/1993 | Levison |
| D369,447 | S | 4/1996 | Levison |
| D405,572 | S | 2/1999 | Bouchez |
| D421,514 | S | 3/2000 | Camp, Jr. et al. |
| D424,258 | S | 5/2000 | Pihl et al. |
| D424,765 | S | 5/2000 | Roeker et al. |
| D426,690 | S | 6/2000 | Sakai |
| D436,702 | S | 1/2001 | Denney |
| D445,227 | S | 7/2001 | Tintelnot |
| D446,616 | S | 8/2001 | Denney |
| D447,299 | S | 8/2001 | Denney |
| D505,528 | S | 5/2005 | Burt et al. |
| D537,255 | S | 2/2007 | Berti |
| D587,416 | S | 2/2009 | Ashe |
| D599,517 | S | 9/2009 | Vrdoljak |
| D599,518 | S | 9/2009 | Vrdoljak |
| D602,660 | S | 10/2009 | Hinder et al. |
| D610,753 | S | 2/2010 | Moskowitz |
| D657,925 | S | 4/2012 | Luipold |
| D667,187 | S | 9/2012 | Sowinski et al. |
| D671,281 | S | 11/2012 | Singer |
| D684,739 | S | 6/2013 | Arnold |
| D694,484 | S | 11/2013 | Angel et al. |
| D708,805 | S | 7/2014 | Mehdizadeh |
| 8,984,667 | B1 | 3/2015 | Parker |
| 9,038,224 | B1 | 5/2015 | Esquibel |
| D768,391 | S | 10/2016 | Kling et al. |
| D787,768 | S | 5/2017 | Daoud et al. |
| D803,650 | S | 11/2017 | Umbrell |
| D804,925 | S | 12/2017 | Umbrell |
| D809,234 | S | 1/2018 | Endle et al. |
| D813,480 | S | 3/2018 | Burazin |
| D825,124 | S | 8/2018 | Celia |
| D830,027 | S | 10/2018 | Zhou |
| D866,891 | S | 11/2019 | Carlson et al. |
| D882,176 | S | 4/2020 | Huang |
| D893,199 | S | 8/2020 | Sedic |
| D895,917 | S | 9/2020 | Hiltenbrand |
| D902,491 | S | 11/2020 | De La Cruz |
| D904,708 | S | 12/2020 | Niedzwecki et al. |
| D916,406 | S | 4/2021 | Chen |
| D929,058 | S | 8/2021 | Santa Cruz |
| D932,126 | S | 9/2021 | Libman et al. |
| D936,923 | S | 11/2021 | Price et al. |
| D946,830 | S | 3/2022 | Schroder et al. |
| D950,872 | S | 5/2022 | Tuman et al. |
| D952,949 | S | 5/2022 | Schroder et al. |
| D953,042 | S | 5/2022 | Kan |
| D956,377 | S | 6/2022 | Brewer |
| D957,770 | S | 7/2022 | Kaicker et al. |
| 11,399,626 | B2 | 8/2022 | Chen |
| D999,532 | S | 9/2023 | Lee et al. |
| D1,010,961 | S | 1/2024 | Truong et al. |
| 11,910,970 | B1 | 2/2024 | Truong et al. |
| D1,025,613 | S | 5/2024 | Truong et al. |
| 2009/0056048 | A1 | 3/2009 | Sharifi |
| 2014/0194900 | A1 | 7/2014 | Sedic |
| 2016/0045081 | A1 | 2/2016 | Kern |
| 2016/0135582 | A1 | 5/2016 | Yen |
| 2017/0303677 | A1 | 10/2017 | Xavier et al. |
| 2018/0042373 | A1 | 2/2018 | Wong et al. |
| 2019/0014899 | A1* | 1/2019 | Powell ..... A46B 13/02 |
| 2019/0282038 | A1 | 9/2019 | Margulis |
| 2020/0077782 | A1 | 3/2020 | Chen |
| 2021/0161286 | A1 | 6/2021 | Hirai |
| 2021/0330084 | A1 | 10/2021 | Chen |
| 2022/0151443 | A1 | 5/2022 | Chen |
| 2022/0331221 | A1 | 10/2022 | Goss |
| 2024/0049924 | A1 | 2/2024 | Truong et al. |
| 2024/0131677 | A1 | 4/2024 | Truong et al. |

FOREIGN PATENT DOCUMENTS

| | | | |
|---|---|---|---|
| CN | 221105657 | U | 6/2024 |
| EP | 2926792 | A1 | 10/2015 |
| GB | 3002168 | | 10/2002 |
| GB | 6260994 | | 2/2023 |
| JP | 5363146 | | 12/2013 |
| KR | 101769410 | | 8/2017 |
| WO | 2021262182 | | 12/2021 |

OTHER PUBLICATIONS

Notification of Grant for Chinese Application No. 202330661028.X, mailed May 10, 2024, 2 pages.

First Office Action for Chinese Application No. 202430009809.5, mailed May 16, 2024, 1 page.

Temu scrubber website 2024, site visited Feb. 19, 2024, https://www.temu.com/ul/kuiper/un9.html?subj=goods-un&_bg_fs=1&_pjump_id =894& _x_vst_scene=adg&goods_id=601099534474778&sku_id=17592292572176&adg_ctx=a-0677150d~c-297803e5~f-316ce38e &_x_ads_sub_channel=shopping&_p_rfs=1&_x_ns_prz_type=1&_x_ns_sku.

"INKERLEE Silicone Face Scrubber Exfoliator Brush, Manual Facial Cleansing Exfoliating Brush, Gentle Face Scrub Wash Brush for Women and Men", retrieved online on Jan. 12, 2024 from url: https://www.amazon.com/INKERLEE-Anti-Slip-Handheld-Cleansing-Exfoliating/dp/B08X3FTTPG/ref=psdc_13861652011_t1_BOCGXCPX9B, Mar. 19, 2021, 8 pages.

"INNERNEED Silicone Face Exfoliating Brush Manual Handheld Facial Cleansing Scrubber Blackhead Remover, Food-Grade Soft Bristle (Dark Blue+Gray)", retrieved online on Jan. 12, 2024 from url: https://www.amazon.com/dp/B09JWHCDMC?ref=emc_s_m_5_i_n, Oct. 20, 2021, 8 pages.

International Search Report and Written Opinion for PCT/US2023/071608, mailed Dec. 4, 2023, 34 pages.

Sud Scrub, Amazon first available date Oct. 11, 2022, retrieved online on Oct. 21, 2023 from url: https://ww.amazon.com/Sud-Scrub-Antimicrobial-Exfoliating-Charcoal/dp/BoBCDL46N, Oct. 11, 2022.

SudScrub YouTube video retrieved online from url: https://www.youtube.com/watch?v=PExtp3RIMAU, Feb. 27, 2021, 62 pages.

First Office Action for CN App No. 202322074168.4 mailed Feb. 10, 2024, pp. all.

Non-Final Office Action received in U.S. Appl. No. 18/320,131 mailed Sep. 25, 2023, pp. all.

Non-Final Office Action received in U.S. Appl. No. 29/913,278 mailed Feb. 23, 2024, pp. all.

Notice of Allowance received in U.S. Appl. No. 18/320,131 mailed Nov. 22, 2023, pp. all.

Notice of Allowance received in U.S. Appl. No. 29/865,722 mailed Oct. 26, 2023, pp. all.

Notice of Allowance received in U.S. Appl. No. 29/913,278 mailed May 13, 2024, pp. all.

Notice of Allowance received in U.S. Appl. No. 29/925,716 mailed Feb. 29, 2024, pp. all.

Office Action received in CN Application No. 202421183144.0 dated Sep. 6, 2024, pp. all.

Restriction Requirement received in U.S. Appl. No. 18/320,131 mailed Aug. 18, 2023, pp. all.

"Tooletries Face & Body Scrubber Review", retrieved from https://packhacker.com/travel-gear/tooletries/face-body-scrubber/ on Sep. 19, 2024, 10 pages.

amazon.com , "Silicone Body Scrubber, Upgrade 3rd Gen Shower Bath Brush, Lather Nicely, Soft Massage Body, More Hygienic Than Traditional Loofah, Gentle Exfoliating for Sensitive Skin, 1 Pack, Rose", retrieved from https://www.amazon.com/BEAUTAIL-Generation-Traditional-Exfoliating-Sensitive/dp/B0CB5F2Q37/ref=pd_rhf_dp_s_pd_sbs_rvi_d_sccl_1_10/139-2166472-8080264?pd_rd_w=Tkyrp&content-id=amzn1.sym.46e2be74-be72-4d3f-86e1-1de279690c4e&pf_rd_p=46e2be74-be72-4d3f-86e1-1 on Sep. 19, 2024, 10 pages.

* cited by examiner

SCRUBBER DEVICE AND CLEANSING SYSTEM

CROSS-REFERENCE TO RELATED APPLICATION

This application is a continuation of U.S. patent application Ser. No. 18/320,131, filed on May 18, 2023, which issued as U.S. Pat. No. 11,910,970 on Feb. 27, 2024, which claims priority from U.S. Provisional Application No. 63/370,873, filed on Aug. 9, 2022, the entire contents of which are incorporated herein by reference.

All patents, patent applications and publications cited herein are hereby incorporated by reference in their entirety. The disclosures of these publications in their entireties are hereby incorporated by reference into this application in order to more fully describe the state of the art as known to those skilled therein as of the date of the invention described and claimed herein.

This patent disclosure contains material that is subject to copyright protection. The copyright owner has no objection to the facsimile reproduction by anyone of the patent document or the patent disclosure as it appears in the U.S. Patent and Trademark Office patent file or records, but otherwise reserves any and all copyright rights.

FIELD OF THE INVENTION

The disclosure herein is directed to a cleansing device that generates and applies a cleansing lather to the body of a user.

BACKGROUND OF THE INVENTION

Bathing is a means of applying cleansing compositions to skin of a body. The process washes away dead skin cells and clears away dirt, oil, and other contaminants. Various types of soaps, body washes, fragrances, and/or other formulas and mixtures are used for bathing purposes. Devices have been developed for purposes of applying the soap and/or body wash product to the body.

SUMMARY OF THE INVENTION

Aspects of the invention are drawn towards a device comprising, a central body, a plurality of dividers, and a handle; the central body comprising a first surface and a second surface; each divider of the plurality of dividers extending upwardly from the first surface of the central body, wherein each divider of the plurality of dividers extends radially from an interior of the first surface to a periphery of the first surface; and a handle attached to the central body. In embodiments, each divider of the plurality of dividers follows a first curved pathway along a first section of the divider. In further embodiments, each divider of the plurality of dividers follows a second curved pathway along a second section of the divider. In embodiments, the first curved pathway comprises a first radius of curvature, wherein the second curved pathway comprises a second radius of curvature. In embodiments, the first radius of curvature is equal to the second radius of curvature. In embodiments, the plurality of dividers comprises a first set of dividers and a second set of dividers. In embodiments, dividers of the first set comprise a first height, wherein dividers of the second set comprise a second height. In embodiments, the first height is different than the second height. In embodiments, the first set of dividers radially extend from a first reference boundary of the interior, wherein the first reference boundary comprises a circle. In embodiments, the second set of dividers radially extend from a second reference boundary of the interior, wherein the second reference boundary comprises a circle. In embodiments, a circumference of the first reference boundary is smaller than a circumference of the second reference boundary. In embodiments, the radially extending plurality of dividers alternate between dividers of the first set and dividers of the second set. In embodiments, an upper edge of each divider comprises a plurality of ridges (e.g., bristles) extending from the upper edge. In embodiments, each ridge of the plurality of ridges comprises a height of 2.5 mm and a width of 1.35 mm. In embodiments, the periphery of the central body comprises a wall surrounding the first surface. The wall can have a raised edge relative to the first surface of the central body. In embodiments, the wall comprises a height of 10.00 mm. In embodiments, an outermost surface (e.g., the wall or another surface) of device forms a polygon. In embodiments, the handle is a strap that is connected to a first side and a second side of the wall, wherein the first side and second side are located on opposing sides of the wall. The strap extends across at least a portion of the second surface of the central body. A user's palm can rest on the second surface to grip the device. In embodiments, the plurality of dividers, the central body, and the handle are integrally formed to have a unitary (e.g., singular) structure that is entirely flexible. In embodiments, the device comprises silicone. In embodiments, an infusement is infused into the silicone. In embodiments, the infusement is infused into the silicone at a concentration of about 20-30 g/kg. In embodiments, the infusement comprises silver phosphate, pyrithione zinc, or a combination thereof. In embodiments, the infusement further comprises a filler. In embodiments, the silver phosphate, pyrithione zinc, or combination thereof comprises about 90% of the infusement and the filler comprises about 10% of the infusement. In embodiments, the infusement comprises about 15 g/kg of silver phosphate and about 15 g/kg of pyrithione zinc. In embodiments, the 15 g/kg of silver phosphate comprises about 10% filler.

Other objects and advantages of this invention will become readily apparent from the ensuing description.

BRIEF DESCRIPTION OF THE FIGURES

FIG. 16A shows the scrubbing device sample at the 28 day timepoint after inoculation with mixed fungi. FIG. 16B shows a microcopy image of the circular samples extracted from the scrubbing device sample of FIG. 16A. FIG. 16C shows the untreated control at the 28 day timepoint after inoculation with the mixed fungi.

DETAILED DESCRIPTION OF THE INVENTION

Figure 1:
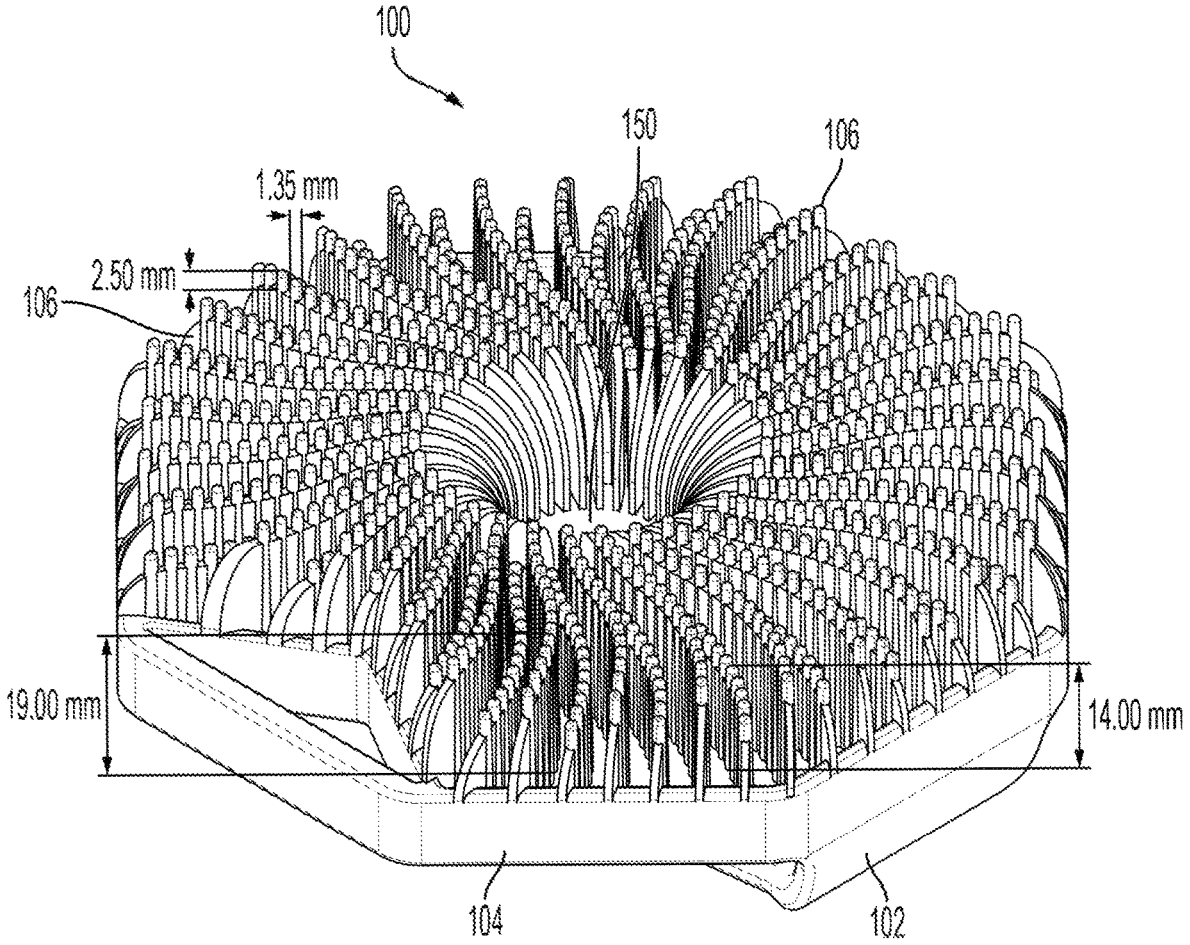
FIG. 1 shows a perspective view of a scrubbing device, under an embodiment.

Detailed descriptions of one or more embodiments are provided herein. It is to be understood, however, that the present invention can be embodied in various forms. Therefore, specific details disclosed herein are not to be interpreted as limiting, but rather as a basis for the claims and as a representative basis for teaching one skilled in the art to employ the present invention in any appropriate manner.

The singular forms "a", "an" and "the" include plural reference unless the context clearly dictates otherwise. The use of the word "a" or "an" when used in conjunction with the term "comprising" in the claims and/or the specification can mean "one," but it is also consistent with the meaning of "one or more," "at least one," and "one or more than one."

Wherever any of the phrases "for example," "such as," "including" and the like are used herein, the phrase "and without limitation" is understood to follow unless explicitly stated otherwise. Similarly, "an example," "exemplary" and the like are understood to be non-limiting.

The term "substantially" allows for deviations from the descriptor that do not negatively impact the intended purpose. Descriptive terms are understood to be modified by the term "substantially" even if the word "substantially" is not explicitly recited.

The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a process involving steps a, b, and c" means that the process includes at least steps a, b and c. Wherever the terms "a" or "an" are used, "one or more" is understood, unless such interpretation is nonsensical in context.

As used herein, the term "about" can refer to approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

As used herein, the term "substantially the same" or "substantially" can refer to variability typical for a particular method is taken into account.

The terms "sufficient" and "effective", as used interchangeably herein, can refer to an amount (e.g., mass, volume, dosage, concentration, and/or time period) needed to achieve one or more desired result(s).

Before explaining at least one embodiment of the disclosure in detail, it is to be understood that the disclosure is not necessarily limited in its application to the details set forth in the following description or exemplified by the examples. The disclosure is capable of other embodiments or of being practiced or carried out in various ways. Other compositions, compounds, methods, features, and advantages of the present disclosure will be or become apparent to one having ordinary skill in the art upon examination of the following drawings, detailed description, and examples. All such additional compositions, compounds, methods, features, and advantages can be included within this description, and be within the scope of the present disclosure.

Figure 6:
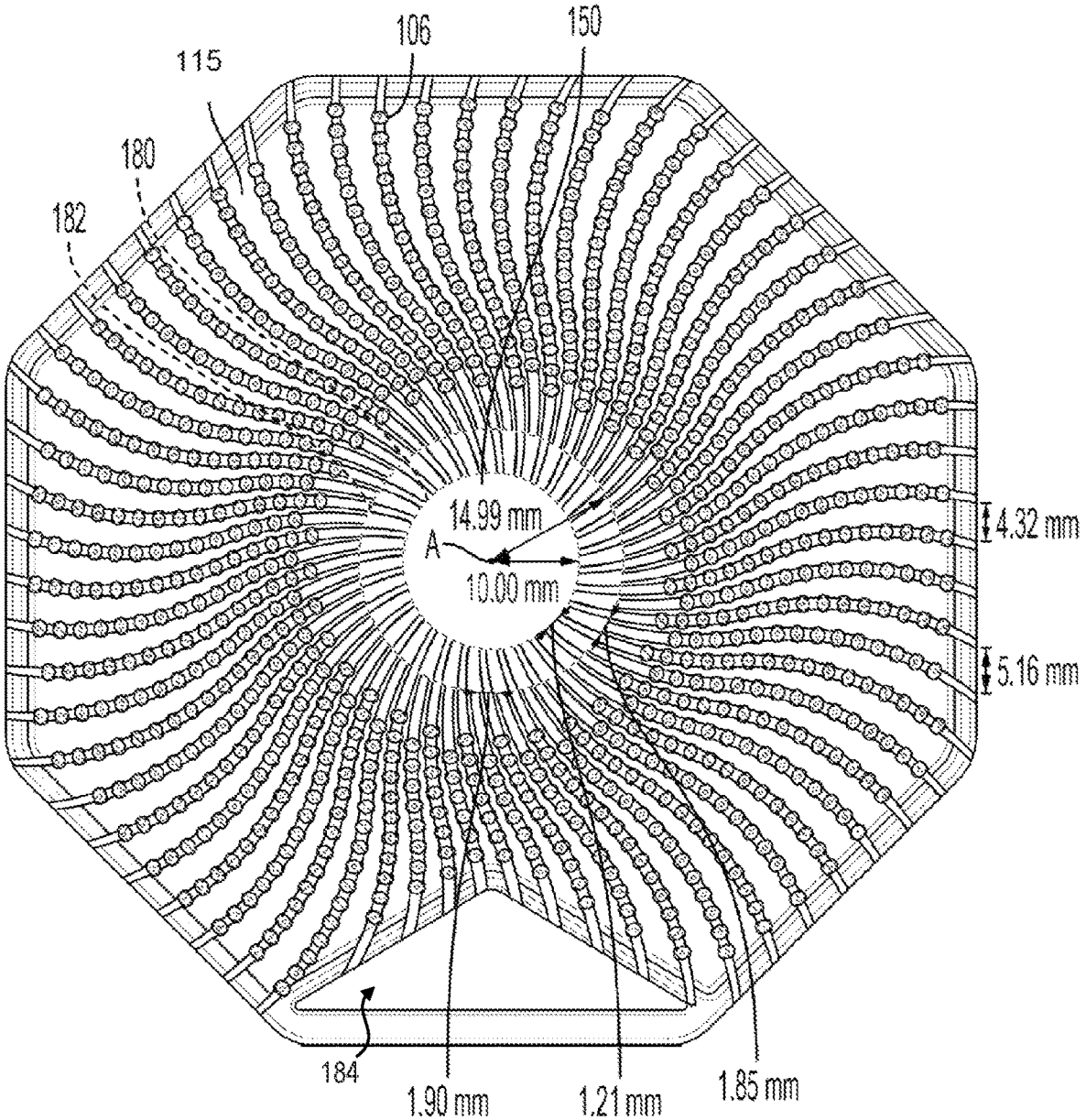
FIG. 6 shows a top view of a scrubbing device, under an embodiment.
Figure 7:
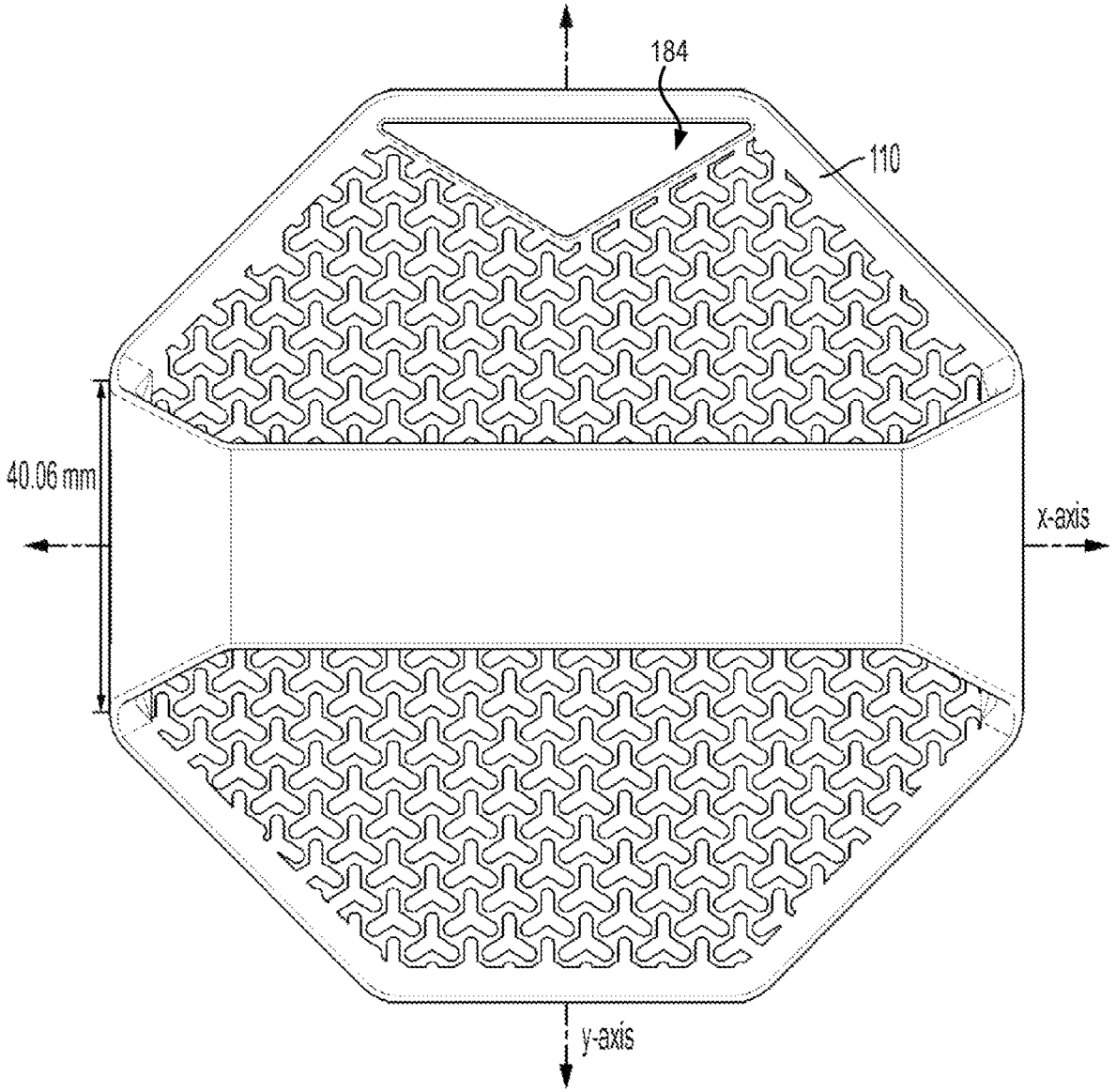
FIG. 7 shows a bottom view of a scrubbing device, under an embodiment.

FIG. 1 shows a perspective view of a scrubbing device (hereinafter referred to as a "scrubber", "scrubber device", "scrubbing device", "Sud Scrub device", "Sud Scrubber", or "device"), under an embodiment. The device 100 comprises a handle 102, a central body 104, and an array of scrubbing fins or dividers 106. As seen in FIGS. 6 and 7, the central body 104 is structurally flexible (e.g., deformable) and comprises a real octagon although embodiments are not so limited. The octagon may be irregular under an embodiment. Further, the central body may comprise a greater or fewer number of straight (equal or unequal) line segments connected to form a closed polygon. The central body may also comprise a circle. The height of the central body is 10.00 mm. Embodiments of the device may include a central body comprising a greater or smaller height. For example, the height of the central body can be about 3.0 mm, about 3.5 mm, about 4.0 mm, about 4.5 mm, about 5.0 mm, about 5.5 mm, about 6.0 mm, about 6.5 mm, about 7.0 mm, about 7.5 mm, about 8.0 mm, about 8.5 mm, about 9.0 mm, about 9.5 mm, about 10.0 mm, about 10.5 mm, about 11.0 mm, about 11.5 mm, about 12.0 mm, about 12.5 mm, about 13.0 mm, about 13.5 mm, about 14.0 mm, about 14.5 mm, or about 15 mm.

Continuing with the example shown in FIGS. 1-7, the central body 104 comprises a lower surface 110 and an upper surface 115. As indicated above, the distance between the upper and lower surfaces is 10.00 mm, in one example. A handle 102 extends from the lower surface 110 of the central body 104. Three (3) point star protrusions cover the lower surface 110 of the device. The stars are aligned in column like fashion across the lower surface. The array of scrubbing fins 106 extend from an upper surface 115 of the scrubbing device. The handle is attached to a first side 120 of the real octangular central body and to a second side 122 of the real octangular central body. The handle features a through opening 124 which receives a hand of a user during use of the device.

Figure 4:
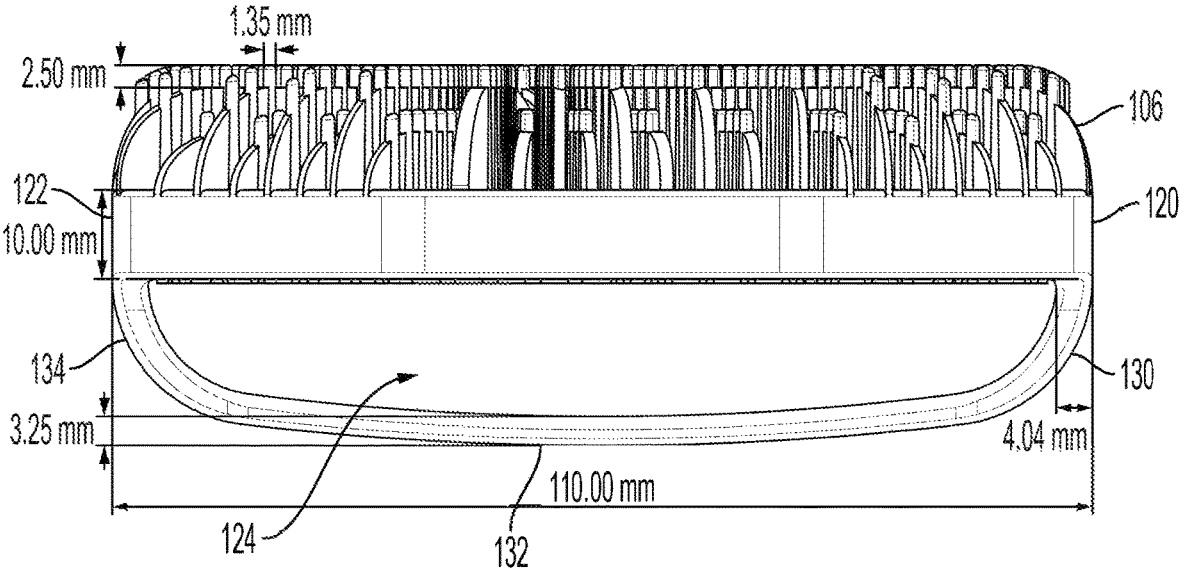
FIG. 4 shows a front view of the scrubbing device, under an embodiment.
Figure 5:
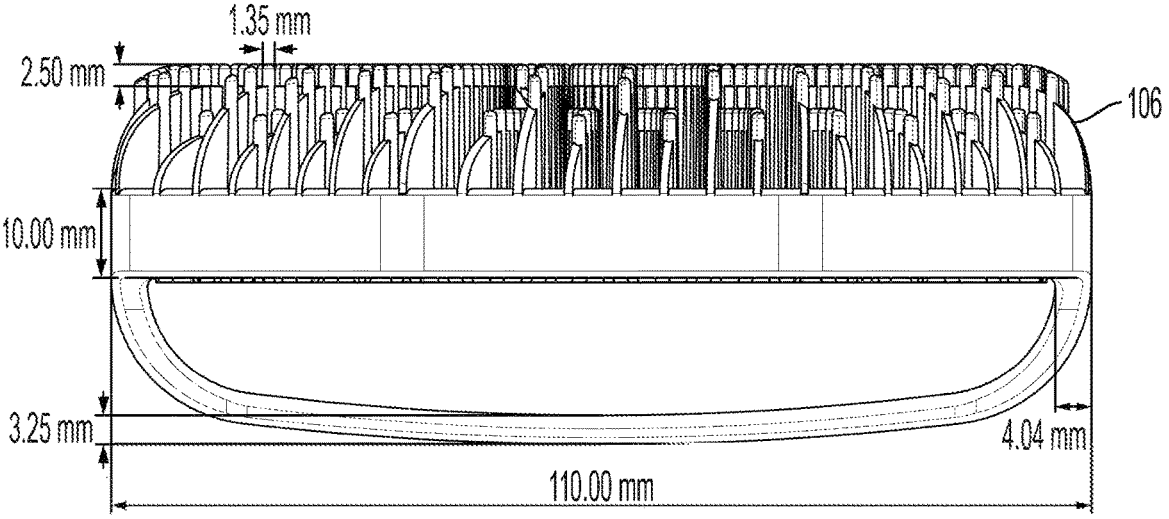
FIG. 5 shows a rear view of a scrubbing device, under an embodiment.

As seen in FIGS. 4 and 5, the handle 102 extends in a downward direction (away from the central body) while also following a trajectory that bends towards a central axis of the device defined by a line extending through the page of FIG. 6 at point "A". A first section 130 of the handle follows a first radius of curvature. A second section 134 of the handle follows a second radius of curvature. As the handle approaches its midsection 132 from either side, the radius of curvature increases so that the central portion of the handle follows a line with a shallow bend. As the pathway of the handle approaches the second side, it follows a second radius of curvature mirroring the first radius of curvature. At the handle's point of attachment to the first and second side of the central body, the handle comprises a thickness of 4.04 mm. The handle comprises a thickness of 3.25 mm at its midsection 132. Note that the distance between the handle's points of attachment (at the first side 120 and second side 122) is 110 mm. Of course, the handle is not limited to these dimensions. For example, the distance between the handle's points of attachment can be about 10 mm, about 15 mm, about 20 mm, about 25 mm, about 30 mm, about 35 mm, about 40 mm, about 45 mm, about 50 mm, about 55 mm, about 60 mm, about 65 mm, about 70 mm, about 75 mm, about 80 mm, about 85 mm, about 90 mm, about 95 mm, about 100 mm, about 105 mm, about 110 mm, about 115 mm, about 120 mm, about 125 mm, about 130 mm, about 135 mm, about 140 mm, about 145 mm, about 150 mm, or about 155 mm.

Figure 2:
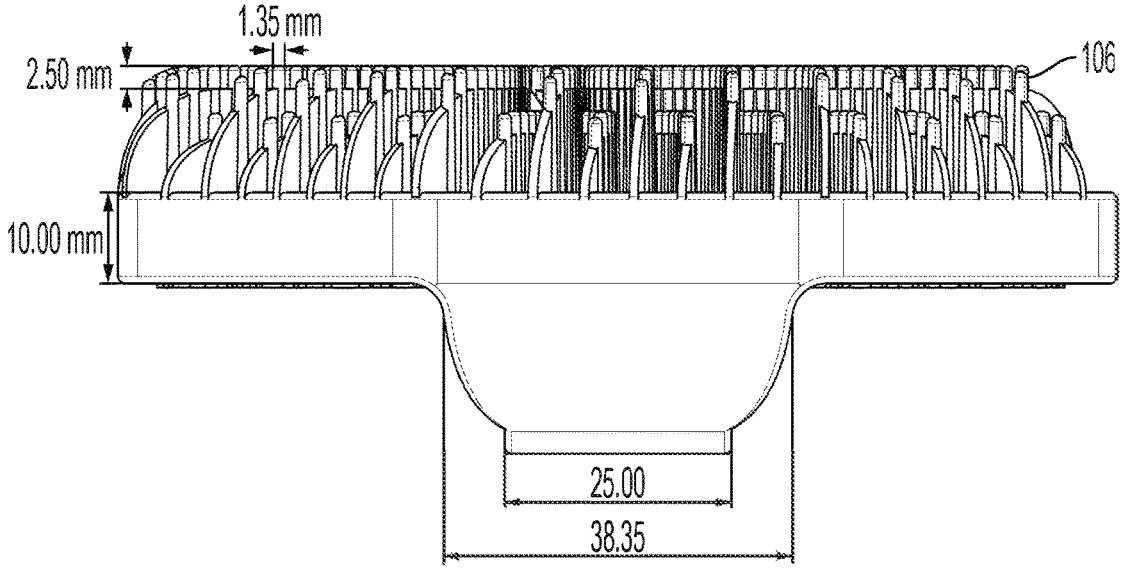
FIG. 2 shows a left view of a scrubbing device, under an embodiment.
Figure 3:
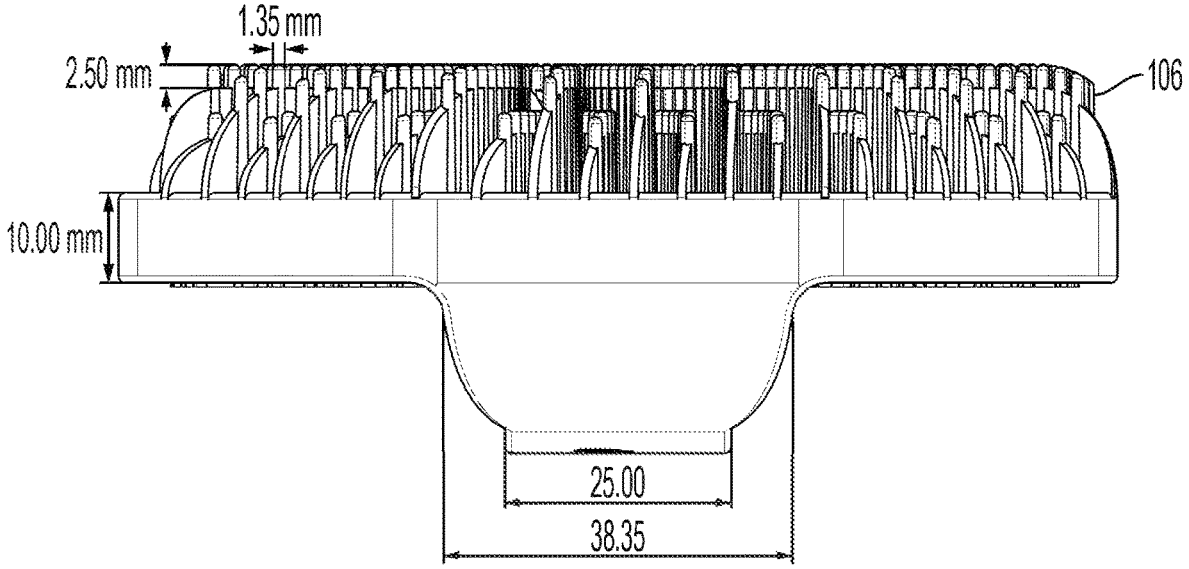
FIG. 3 shows a right view of the scrubbing device, under an embodiment.

As seen in FIGS. 2 and 3, the handle comprises a width of 25 mm at its midsection. As the handle approaches a point of attachment with the first side 120 and second side 122, the handle spans the 40.06 mm length of each side (FIG. 7).

A user may control the scrubbing device by simply extending fingers through the handle with palm facing the lower surface 110 of the central body 104. A user's hand resides within the handle in an interference fit while the user applies the scrubbing device to the body (as further described below). Of course, a user may grip the handle in an alternative fashion. For example, a user may grip the handle using a fist and similarly apply the scrubbing device to target areas of the body.

Scrubbing fins 106 extend upwardly from the upper surface 115 of the scrubbing device. The fins are attached at their proximal ends to an interior portion 150 of the central body's upper surface 115. The fins extend radially from the inner portion 150 of the upper surface 115. The inner portion 150 comprises a first circle 180 and a second circle 182 (seen in broken lines in FIG. 6). The first circle comprises a radius of 10.0 mm, and the second circle comprises a radius of 14.99 mm. A first set of fins radially extend from the circumference of first circle 180 while a second set of fins extend from the circumference of second circle 182. Proximal ends of the first set of fins are equally spaced around the first circle, and proximal ends of the second set of fins are equally spaced around the second circle.

Figure 8:
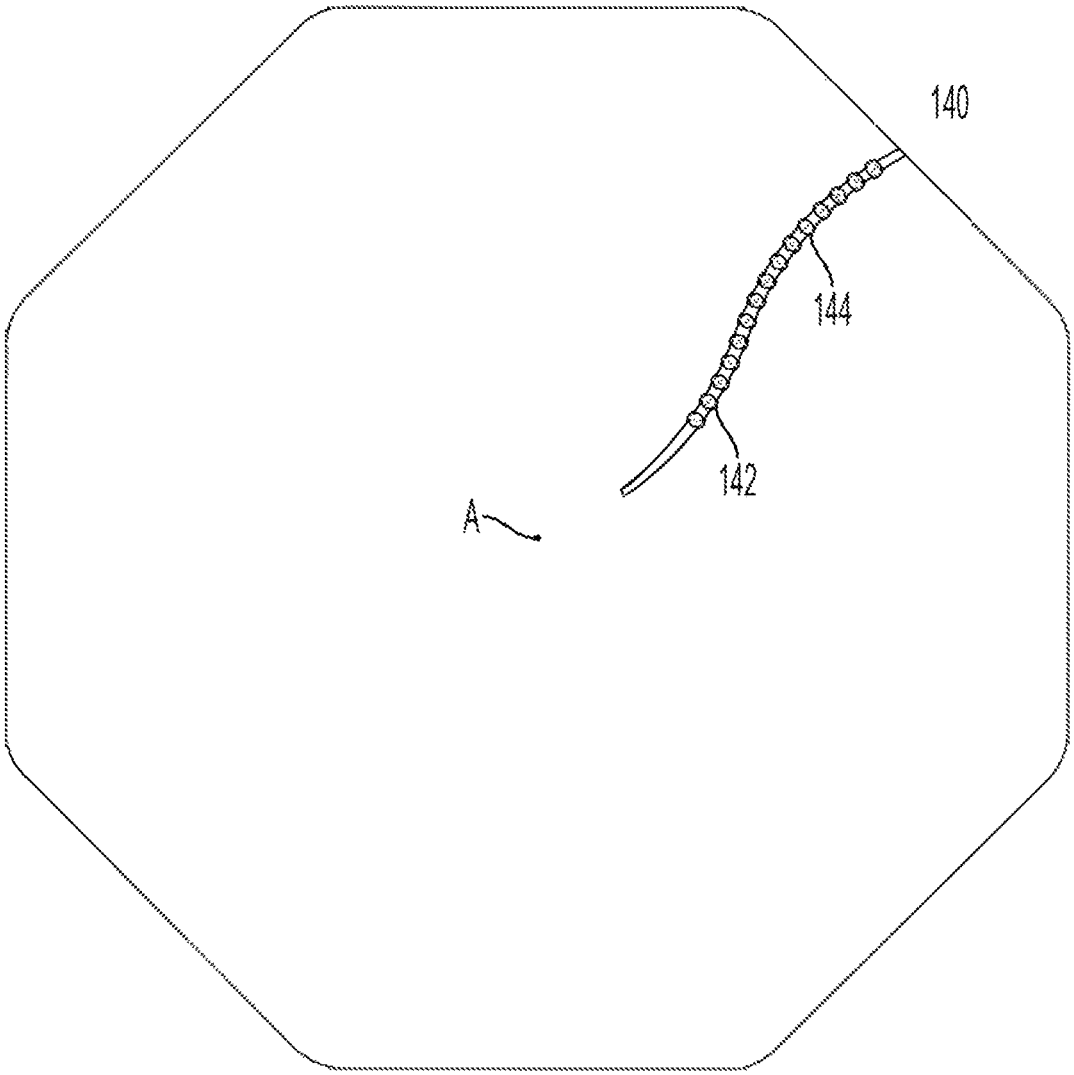
FIG. 8 shows a top view of a single scrubbing fin, under an embodiment.
Figure 9:
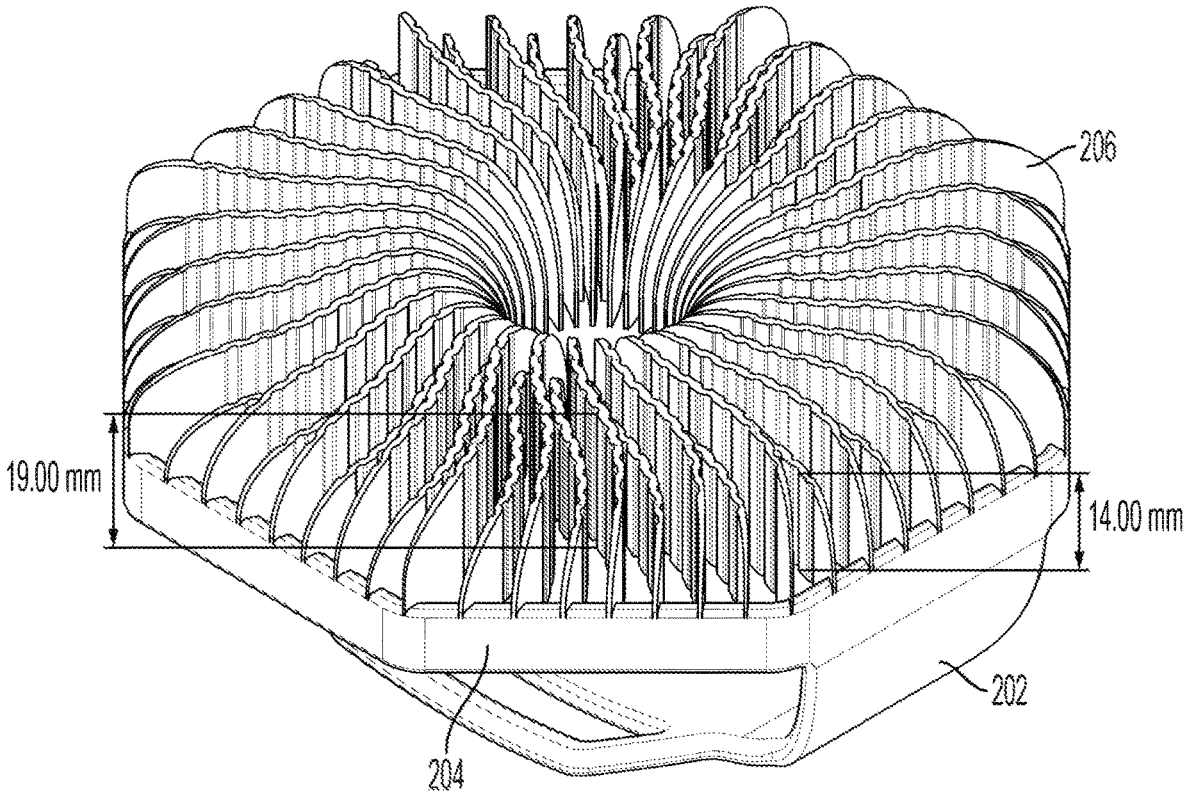
FIG. 9 shows a perspective view of a scrubbing device, under an embodiment.

The array of fins forms a wave pattern where each fin follows an alternating curved pathway extending from the interior 150 of the central body. FIG. 8 shows a single fin 140 for purposes of illustrating its curved pathway. Fin 140 includes a first section 142 and a second section 144. The first section comprises a first radius of curvature while the second section comprises a second radius of curvature. The first radius of curvature may be the same as the second radius of curvature. The transition from the first section the second section may comprise a point of inflection. Under alternative embodiments, each fin may extend along a straight line. Further, the fins of a device may comprise varying curved pathways.

The radially extending plurality of fins circumferentially populate the upper surface 115 of the central body. The fins alternate between a height of 14 mm and 19 mm. Of course, alternative embodiments may include (i) fins of uniform height or (ii) fins of varying heights. If varying in height, the fins may be arranged in circumferentially repeating patterns or in an irregular format. In some embodiments, the fins can be a height of about 3.0 mm, about 3.5 mm, about 4.0 mm, about 4.5 mm, about 5.0 mm, about 5.5 mm, about 6.0 mm, about 6.5 mm, about 7.0 mm, about 7.5 mm, about 8.0 mm, about 8.5 mm, about 9.0 mm, about 9.5 mm, about 10.0 mm, about 10.5 mm, about 11.0 mm, about 11.5 mm, about 12.0 mm, about 12.5 mm, about 13.0 mm, about 13.5 mm, about 14.0 mm, about 14.5 mm, about 15 mm, about 15.5 mm, about 16.0 mm, about 16.5 mm, about 17.0 mm, about 17.5 mm, about 18.0 mm, about 18.5 mm, about 19.0 mm, about 19.5 mm, about 20.0 mm, about 20.5 mm, about 21.0 mm, about 21.5 mm, about 22.0 mm, about 22.5 mm, about 23.0 mm, about 23.5 mm, about 24.0 mm, about 24.5 mm, or about 25 mm.

An upper edge of each fin features a series of ridges. Each ridge is 2.5 mm in height and 1.35 mm in width. The ridges are uniform in height and uniformly distributed along each fin's upper edge. Of course, this height, width, and gap dimension may vary. Further, fins of alternative embodiments may feature ridges of varying shapes, heights, width, and gaps. In some embodiments, the height of the ridge is about 1 mm, about 1.5 mm, about 2 mm, about 2.5 mm, about 3 mm, about 3.5 mm, about 4 mm, about 4.5 mm, or about 5 mm. In some embodiments, the width of the ridge is about 0.5 mm, about 0.55 mm, about 0.6 mm, about 0.65 mm, about 0.7 mm, about 0.75 mm, about 0.8 mm, about 0.85 mm, about 0.9 mm, about 0.95 mm, about 1 mm, about 1.15 mm, about 1.25 mm, about 1.35 mm, about 1.45 mm, about 1.5 mm, about 1.55 mm, about 1.65 mm, about 1.75 mm, about 1.85 mm, about 1.95 mm, about 2 mm, about 2.15 mm, about 2.25 mm, about 2.35 mm, about 2.45 mm, about 2.5 mm, about 2.55 mm, about 2.65 mm, about 2.75 mm, about 2.85 mm, about 2.95 mm, or about 3 mm.

The scrubbing device of FIGS. 1-8 is used to apply cleansing compositions to skin of a user's body. For purposes of this discussion, the cleansing composition may be traditional bar soap. A user typically combines soap and water to generated soapsuds, i.e., a froth made from soap and water. The scrubbing device provides a structure that effectively delivers cleansing compositions to a skin surface while providing antimicrobial properties during use and in storage. In use, fins of the device are frictionally applied to skin of the user along with water and soap. As one example, a user may apply the device to an area of skin in a rotational and/or linear manner. The fins of the device capture water and soap and deliver it to skin of the body in a sweeping, circular, or reciprocating motion which frictionally applies soapsuds and ridges of the fins to the skin surface.

As the device moves across the skin, the fins capture the lather in chambers. The chambers are defined by the upper surface 115 of the device, adjacent fin walls, and skin of the user. As indicated, the fins radially extend from an interior of the central body. With respect to FIG. 7 (orienting a top view of the scrubber along an x-axis and y-axis), a user may move the device in a linear motion along the x-axis. As the user moves the device, the user also places downward pressure on the device. This downward pressure causes the fins laterally disposed to the x-axis to collapse upon each other in a brushing motion. During this motion, upper edges of adjacent fins contact the skin. As the fins collapse together, the distance between skin surface and an upper surface of device body decreases thereby decreasing the volume of the collapsing chamber and forcing lather from chambers onto the skin. The collapsing effect increases as the radial axis of the fins are increasingly colinear with the y-axis. For example, the collapsing effect is greatest for fins extending along a line forming a 90-degree angle with the x-axis. The effect decreases as such angle increases from 90 degrees to 180 degrees. Of course, a user may direct the device in various and mixed patterns which will vary the characteristic of this collapsing effect.

FIGS. 9-15 show an alternative embodiment of the scrubbing device. The alternative embodiment features a central body 204, a plurality of fins 206, and a handle 202. The alternative embodiment is analogous to the device of FIGS. 1-8. The key difference is that the fins of the alternative embodiment do not feature ridges. The alternative embodiment is similarly dimensioned. However, the alternative embodiment may feature slightly different dimensions.

Figure 10:
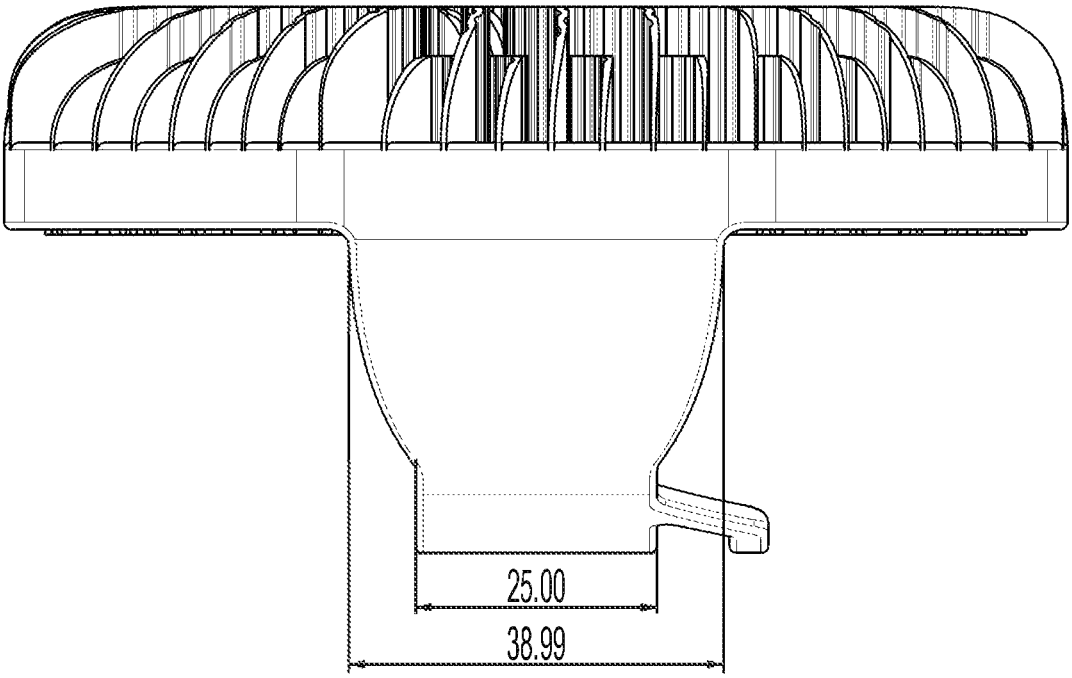
FIG. 10 shows a left view of a scrubbing device, under an embodiment.
Figure 11:
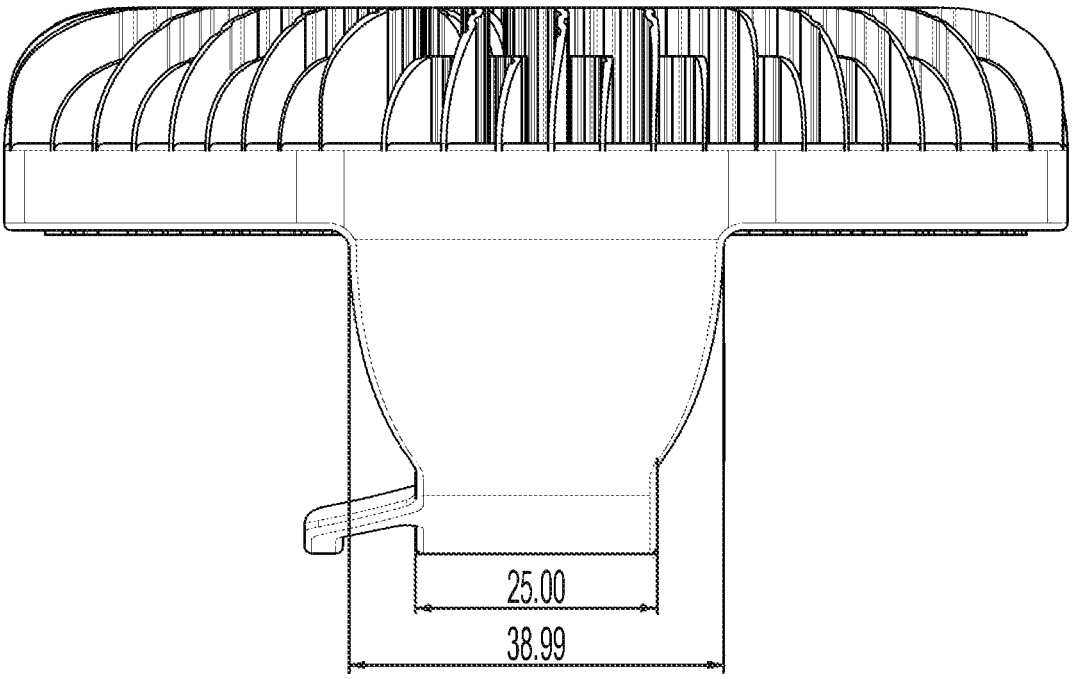
FIG. 11 shows a right view of the scrubbing device, under an embodiment.
Figure 12:
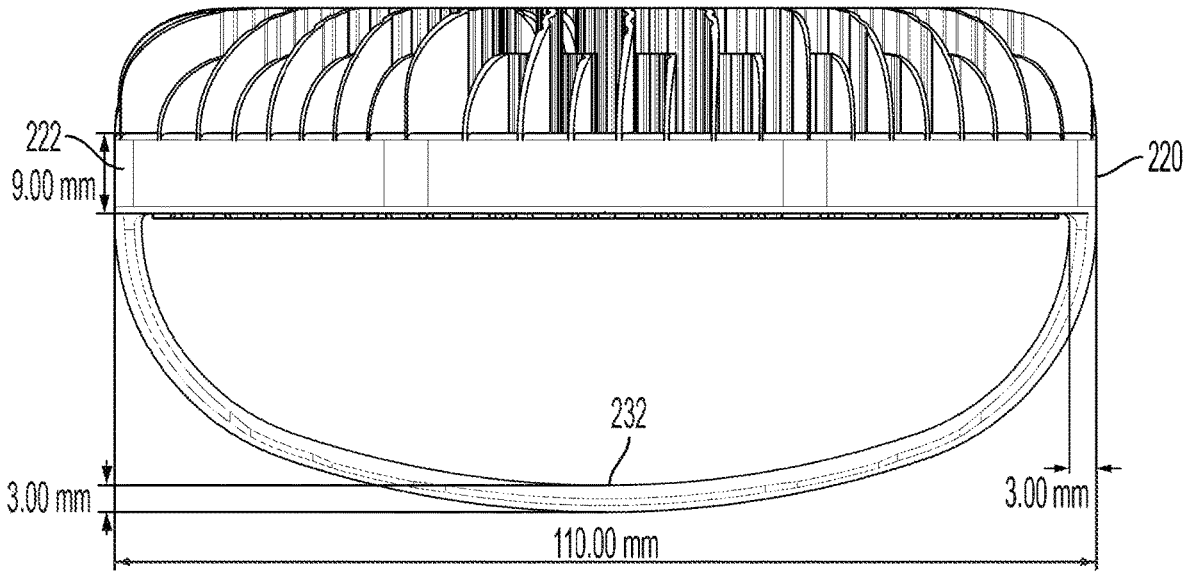
FIG. 12 shows a front view of the scrubbing device, under an embodiment.
Figure 13:
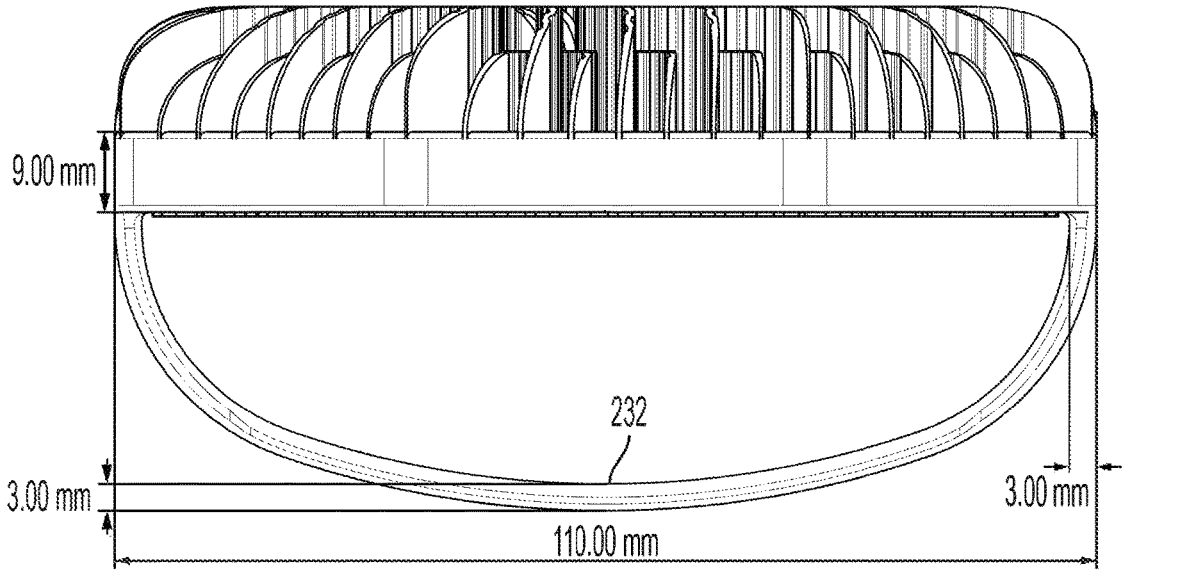
FIG. 13 shows a rear view of a scrubbing device, under an embodiment.
Figure 14:
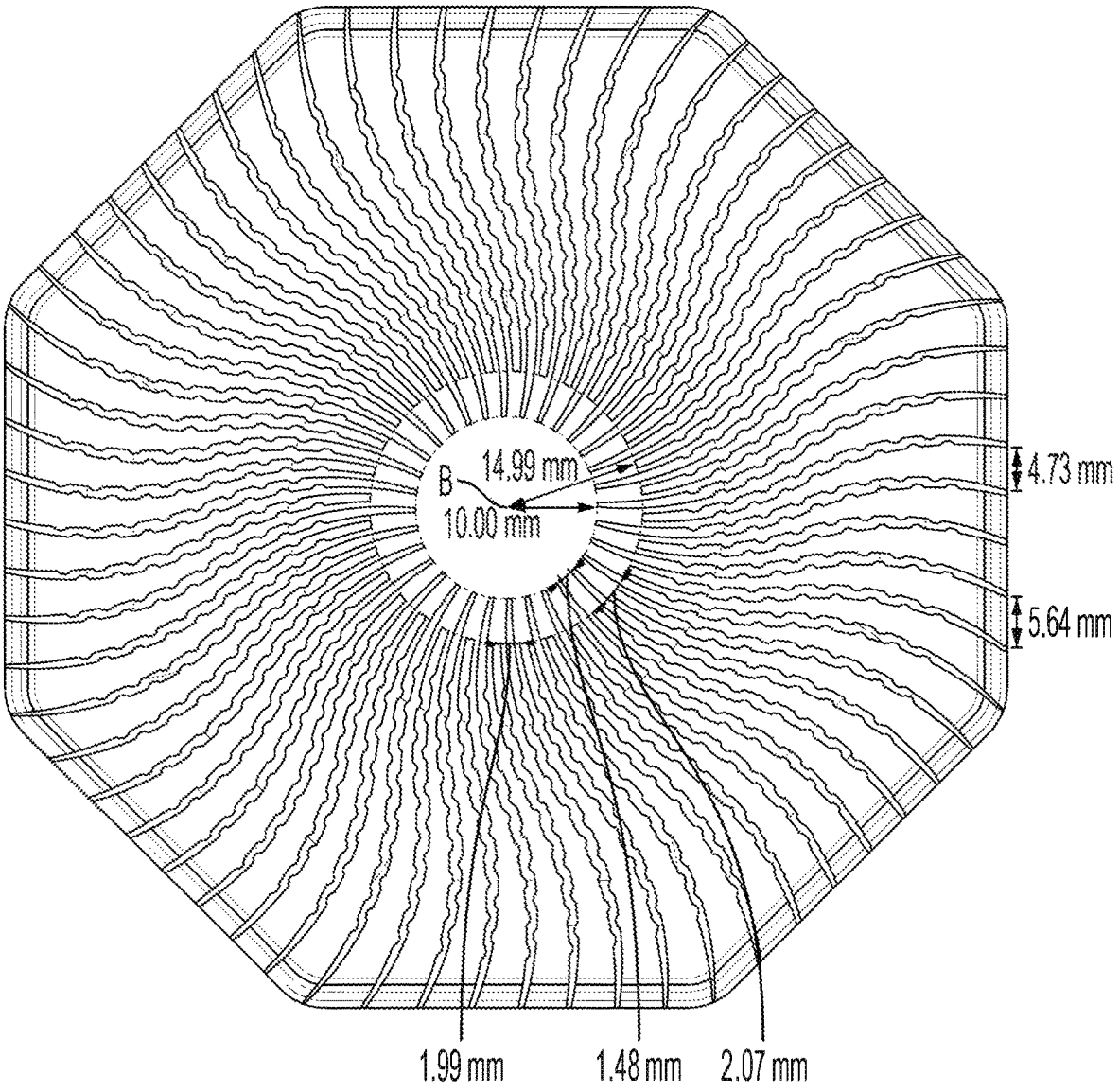
FIG. 14 shows a top view of a scrubbing device, under an embodiment.
Figure 15:
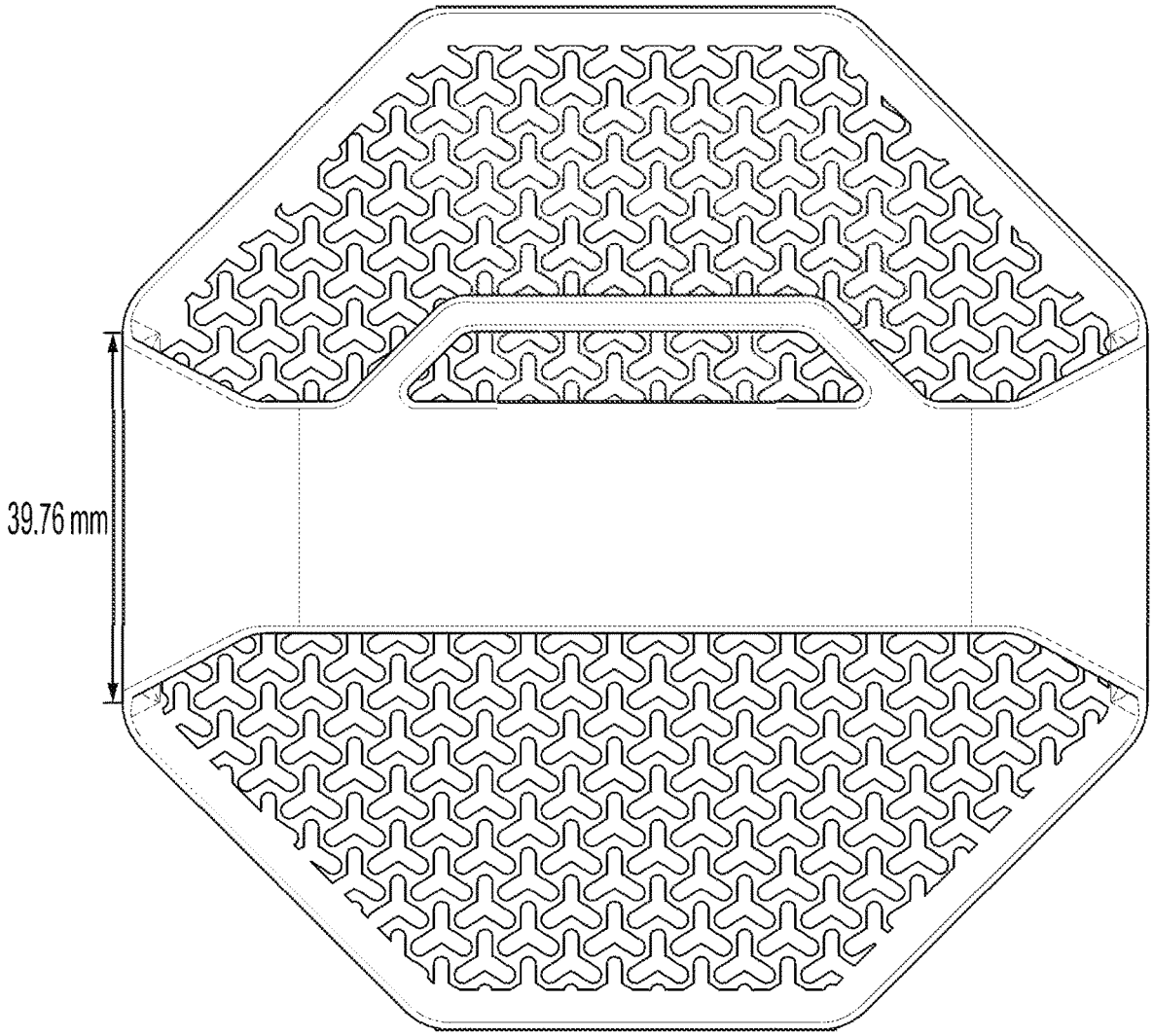
FIG. 15 shows a bottom view of a scrubbing device, under an embodiment.

As one example, the height of the central body 204 is 9.00 mm. In some embodiments, the height of the central body can be about 3.0 mm, about 3.5 mm, about 4.0 mm, about 4.5 mm, about 5.0 mm, about 5.5 mm, about 6.0 mm, about 6.5 mm, about 7.0 mm, about 7.5 mm, about 8.0 mm, about 8.5 mm, about 9.0 mm, about 9.5 mm, about 10.0 mm, about 10.5 mm, about 11.0 mm, about 11.5 mm, about 12.0 mm, about 12.5 mm, about 13.0 mm, about 13.5 mm, about 14.0 mm, about 14.5 mm, or about 15 mm. As another example (as seen in FIGS. 12 and 13), the handle 202 comprises a thickness of 3.00 mm at its point of attachment to the first side 220 and second side 222 of the central body. The handle comprises a thickness of 3.00 mm at its midsection 232. Note that the distance between the handle's points of attachment (at the first side 220 and second side 222 of the central body) is 110 mm. In some embodiments, the distance between the handle's points of attachment can be about 10 mm, about 15 mm, about 20 mm, about 25 mm, about 30 mm, about 35 mm, about 40 mm, about 45 mm, about 50 mm, about 55 mm, about 60 mm, about 65 mm, about 70 mm, about 75 mm, about 80 mm, about 85 mm, about 90 mm, about 95 mm, about 100 mm, about 105 mm, about 110 mm, about 115 mm, about 120 mm, about 125 mm, about 130 mm, about 135 mm, about 140 mm, about 145 mm, about 150 mm, or about 155 mm. As seen in FIGS. 10 and 11, the handle comprises a width of 25 mm at its midsection. As the handle approaches a point of attachment with the first side 220 and second side 222, the handle spans the 39.76 mm length of each side (FIG. 15).

FIGS. 9-15 show dimensions of the device under an alternative embodiment.

Described herein are non-limiting embodiments of the materials which can be used to manufacture the scrubber device. It is to be understood that many different materials may be used for forming the scrubber device. For example, materials can include polymers, enhanced polymers, vinyl, polyvinyl chloride (PVC), polydimethylsiloxane (PDMS), fluoropolymers, rubber, metals such as aluminum, steel, copper, and the like, metal composites, carbon fiber, as well as other combinations of materials that are resistant to destruction while preserving the contents of the interior and maintaining sterility within. For example, the scrubber device main body can be formed of a combination of materials making up different components such as silicone, infused silicone and/or rubber. In embodiments, the scrubber device can be manufactured from silicone. As used herein, the term "silicone" can refer to polysiloxane, a polymer of siloxane.

In embodiments, the material used to manufacture the scrubber device can be infused and/or coated with antimicrobial, antifungal, and/or antifouling agents. In embodiments, the scrubber devices can be formed of any suitable mixture, contents, and/or formula and is formed of an antimicrobial infusement. As used herein the term "infusement" can refer to any compound or mixture of compounds that is infused into and/or mixed into the materials used to manufacture the scrubbing device. For example, the scrubber can be manufactured with silicone that is infused with an agent that kills microorganisms and/or stops microorganism growth. Furthermore, in this way, the infused silicone can prevent bacterial growth and/or other growth that leads to unhealthy use such as is found in porous bath and shower devices that have highly porous network of fibers. Examples include a loofah, mesh sponge, or poof devices. Additionally, and in this way, the device can last longer than traditional loofah or other porous bath and shower devices. Additionally, and in this way, the device does not develop odors or other undesirable characteristics, such as with traditional loofah devices or other porous bath and shower devices.

In embodiments, the antimicrobial and/or antifouling agents can include, but are not limited to, silver, silver phosphate, zinc, pyrithione zinc, isothiazolinone, quaternary ammonium, zwitterions, sulfobetaines, triazole compounds, triclosan, benzyalkonium chloride (BAC), chlorhexidine, carboxybetaines, compounds, antibiotics, antifungals, penicillin, aminoglycosides, ofloxacin, erythromycin, tetracycline, chloramphenicol, titanium, cobalt, nickel, zirconium, molybdenum, tin, lead, gold, copper, other metals, a combination thereof, and the like.

In embodiments, the antimicrobial and/or antifouling agents can be present in concentration of about 1 mg/kg, about 10 mg/kg, about 100 mg/kg, about 500 mg/kg, about 1 g/kg, about 5 g/kt, about 10 g/kg, about 15 g/kg, about 25 g/kg, about 50 g/kg, about 100 g/kg, about 500 g/kg, about 1 kg/kg of scrubber body material. For example, the antimicrobial agent is present in a concentration of about 15-30 g/kg of scrubber body material. For example, silver phosphate is infused into silicone at a concentration of about 15-30 g/kg. For example, pyrithione zinc is infused into silicone at a concentration of about 15-30 g/kg. In some embodiments, a combination of silver phosphate and pyrithione zinc is infused into silicone at concentrations of about 15 g/kg and about 15 g/kg respectively.

In embodiments, a combination of silver phosphate at a concentration of about 1 g/kg, about 2 g/kg, about 3 g/kg, about 4 g/kg, about 5 g/kg, about 6 g/kg, about 7 g/kg, about 8 g/kg, about 9 g/kg, about 10 g/kg, about 11 g/kg, about 12 g/kg, about 13 g/kg, about 14 g/kg, about 15 g/kg, about 16 g/kg, about 17 g/kg, about 18 g/kg, about 19 g/kg, about 20 g/kg, about 21 g/kg, about 22 g/kg, about 23 g/kg, about 24 g/kg, about 25 g/kg, about 26 g/kg, about 27 g/kg, about 28 g/kg, about 29 g/kg, or about 30 g/kg and zinc at a concentration of about 1 g/kg, about 2 g/kg, about 3 g/kg, about 4 g/kg, about 5 g/kg, about 6 g/kg, about 7 g/kg, about 8 g/kg, about 9 g/kg, about 10 g/kg, about 11 g/kg, about 12 g/kg, about 13 g/kg, about 14 g/kg, about 15 g/kg, about 16 g/kg, about 17 g/kg, about 18 g/kg, about 19 g/kg, about 20 g/kg, about 21 g/kg, about 22 g/kg, about 23 g/kg, about 24 g/kg, about 25 g/kg, about 26 g/kg, about 27 g/kg, about 28 g/kg, about 29 g/kg, or about 30 g/kg is infused into the body of the scrubber.

As used herein, it is understood that any composition mentioned herein can comprise a certain amount of a filler. For example, the term "silver phosphate," as used herein, can refer to silver phosphate and a certain amount of a filler. For example, a composition can comprise less than 1% filler, about 2.5% filler, about 5% filler, about 10% filler, about 15% filler, about 20% filler, about 30% filler, about 40% filler, about 50% filler, about 60% filler, about 70% filler, or more than 70% filler.

In embodiments, the scrubber device can be infused with an infusement that is a combination of an antimicrobial and/or antifouling agent and a filler. In one example, the infusement comprises less than 1% filler, about 2.5% filler, about 5% filler, about 10% filler, about 15% filler, about 20% filler, about 30% filler, about 40% filler, about 50% filler, about 60% filler, about 70% filler, or more than 70% filler. In embodiments, the infusement comprises about 90% silver phosphate and about 10% filler. For example, the filler is zeolite. In embodiments, the infusement comprises about 90% pyrithione zinc and about 10% filler. In one example, the filler is zeolite. In embodiments, the scrubber device can be infused with about 15 g/kg of silver phosphate and about 15 g/kg of pyrithione zinc. For example, the scrubber can be infused with about 15 g/kg of about 90% silver phosphate and 10% filler and about 15 g/kg of pyrithione zinc.

As used herein, a filler can refer to a material that is not the antimicrobial and/or antifouling agent. In one example, the filler can improve material properties, reduce cost, or a combination thereof. In embodiments, non-limiting examples of filler can comprise zeolite, glass, nanofillers, polymers, polymer foam beads, fly ashes, calcium carbonate, kaolin, carbon black, talc, mica, silica, zinc oxide, minerals, particulates, fibers, or a combination thereof. As used herein, zeolite can refer to porous aluminosilicate minerals. For example, the zeolite can be a naturally occurring zeolite or a synthetically produced zeolite.

In embodiments, the infused material can be manufactured by heating the scrubber body material to the point of melting and then adding the antimicrobial and/or antifouling agent while mixing. In embodiments, the antimicrobial and/or antifouling agent is homogenously dispersed throughout the material. In one example, the material is silicone, and the antimicrobial agent is silver phosphate. For example, the silver phosphate can be present in an amount of about 20-30 grams of silver phosphate per 1 kg of silicone. In one example, the material is silicone and the antimicrobial agent is pyrithione zinc. In one example, the material is silicone, and the antimicrobial agent is a combination of silver phosphate and pyrithione zinc present in concentrations of about 15 kg/g and about 15 g/kg respective. In one example, the pyrithione zinc can comprise about 10% filler. For example, the filler can be zeolite.

EXAMPLES

Examples are provided below to facilitate a more complete understanding of the invention. The following examples illustrate the exemplary modes of making and practicing the invention. However, the scope of the invention is not limited to specific embodiments disclosed in these Examples, which are for purposes of illustration only, since alternative methods can be utilized to obtain similar results.

Example 1

Non-Limiting, Exemplary Antibacterial Testing

The ISO-22196 test is a method of evaluating the antibacterial activity of plastic products. It can be used for evaluating the antimicrobial properties of many material types that can range from coated surfaces or those of monolithic composition. Antimicrobial activity can be determined in the following manner:

$$R=(Ut-U0)-(At-U0)=Ut-At, \text{ wherein}$$

R is the antibacterial activity;

U0 is the average of the common logarithm of the number of viable bacteria, in cells/cm2, recovered from the untreated test specimens immediately after inoculation;

Ut is the average of the common logarithm of the number of viable bacteria, in cells/cm2, recovered from the untreated test specimens after 24 hours (hrs);

At is the average of the common logarithm of the number of viable bacteria, in cells/cm2, recovered from the treated test specimens after 24 hr.

For purposes of common reference, the % reduction is also reported in the notes section of the sample results.

Legend

CFU—colony forming unit (typically cited per unit volume of surface area). CFU is determined by bacterial plating of the test samples according to the specified method, followed by counting of the resultant colonies.

Untreated Control (UTC)—untreated control sample material used to demonstrate normal test performance, showing robust microorganism growth.

Interval—can refer to the point or time point from which the result value was determined; T0 indicates that the result is from the soonest possible time from inoculation to recovery of the inoculated sample (for example, <5 min).

Result—can refer to the measure of change or abundance. Result units indicate the actual measurements, for example, relative to a control value depending on the method or test requirements.

Notation of changes to the published test method:

Several references are made to 'Plate count agar' for the test method plating following neutralization and recovery of the bacterial from the test samples. As standard practice, counts are performed on appropriate plate media such as Nutrient agar, tryptic soy agar, or as required by the specific organism tested. The published standard refers to incubation conditions of 35+/−1 C. Standard microbiological practice with other international methods is for incubations to occur at 37 C+/−1 C. The test conditions performed will be conducted at 37 C+/−1 C unless specified for other temperature conditions Current Laboratory Standard:

Test measurement uncertainty is based on established standard provided in SOP 070601 Measurement Uncertainty Estimates. The measurement uncertainty for this test method can be found in FORM 071102 Bacterial Inoculum OD Correlation Table.

Expanded Uncertainty for the test method of k=2 is for 95% confidence of Log 10 (0.136)

Uncertainty Values in CFU are obtained by converting CFU counts (C1) to Log 10 values (Log 10 C1) multiply this result by the Expanded Uncertainty (Log 10 C1*EU), then add and subtract from the Log 10 value (Log C1+/−(Log 10C1*EU)); convert back by taking the anti-log (1×10^(Log C1+/−(Log 10 C1*EU) which provides the upper and lower limits of 95% confidence in CFU. The antimicrobial performance is reported as both the Log 10 and % reduction relative to the untreated control sample.

Test Sample Result

Timepoint of the result: (T0 or other time in test)

Timepoint Units: "hr"

Results: Log Reduction rounded to nearest tenths

UNITS: Log Reduction

Introduction

ISO 22196 specifies a method of evaluating the antibacterial activity of plastic products. It is a method commonly used for evaluating the antimicrobial properties of many material types that can range from coated surfaces or those of monolithic composition.

Testing

Inoculum Preparation—following an overnight incubation of the test bacteria, a transfer to the inoculation solution is performed. Transfer the test bacteria into a small about of 1/500 NB prepared. A dilute of this suspension with 1/500 NB is created as appropriate to establish an estimated bacterial concentration, to obtain a bacterial concentration that is between 1E6 CFU/ml and 4E6 CFU/ml, with a target concentration of 2.5E6 CFU/ml Inoculation of Test Specimens:

The surface to be tested is the exposed outer surface of the product.

Pipette 0.1 ml of the test inoculum prepared onto the test surface.

Cover the test inoculum with a piece of film that measures 30 mm×30 mm and gently press down on the film so that the test inoculum spreads to the edges.

Make sure that the test inoculum does not leak beyond the edges of the film.

After the specimen has been inoculated and the cover film applied, replace the lid of the Petri dish Incubation of the Inoculated Test Specimens The standard procedure for incubation of the inoculated specimens is to incubate the Petri dishes containing the inoculated test specimens (including half of the untreated test specimens) at a temperature of (37+/−) C and a relative humidity of not less than 90% for (24+/−1) h, unless otherwise noted.

Recovery of Bacteria

After the need plate incubation, count the viable bacteria to determine the recovered bacteria concentrations for each sample replicate Reagents: Nutrient Both 2 (NB2), D/E Neutralizing Broth (D/E), Phosphate Buffered Saline (PBS), Tryptic Soy Agar, and Laboratory RO water, deionized Equipment List: Orbital Shaker Incubator, Balances, Autoplater, Linitest, Water Incubator, Spectrophotometer, pH meter/$O_2$ measure/conductivity meter, hygrometer, pipetters.

| Test Organisms | Inventory ID/Lot # | |
|---|---|---|
| *Staphylococcus aureus* | 6538 | 299040-1 |
| *Escherichia coli* | 8739 | 305629 |

Sample Preparations

Each test substance was prepared according to the analytic method requirements. Each test sample is prepared in triplicate unless otherwise specified. As available, flat samples are procured, and cut into a piece 50×50 mm. Sample variability is accommodated at needed for the standard test. The test sample will be flat and allow a layering of film over the sample surface during testing. At a minimum, samples will be managed in a way to prevent evaporation of the inoculum from the sample surface during testing, which is confirmed visually following testing. Samples were cut into pieces 40×40 mm Sampling Procedure Unless specified, samples will be cut from the provided pieces or used as received if precut. Unless specified, the sample provided is treated as uniform, and monolithic for the purposes of testing, selective cutting, sidedness, or other types of potential sample heterogeneity are disregarded unless instructions for sample handling and noted.

Calculations $$\text{Antimicrobial performance}==R=(Ut-U0)-(At-U0)=Ut(24\text{ h})-At(24\text{ h}),\text{ wherein}$$

R is the antibacterial activity;

U0 is the average of the common logarithm of the number of viable bacteria, in cells/cm2, recovered from the untreated test specimens immediately after inoculation;

Ut is the average of the common logarithm of the number of viable bacteria, in cells/cm2, recovered from the untreated test specimens after 24 h;

At is the average of the common logarithm of the number of viable bacteria, in cells/cm2, recovered from the treated test specimens after 24 hr.

Table 1 shows the measurement of Antibacterial Activity on Plastic Surfaces.

TABLE 1

| Test Method<br>ISO 122196-Measurement of antibacterial activity on plastic surfaces | | |
|---|---|---|
| | Interval | Result |
| Sample #1 Sudscrub<br>Inoculum: *S. aureus* (6538) | | |
| Notes Section | | |
| 99.99% reduction | 24 hr | 4.3 Log10 Reduction |
| Inoculum: *E. coli* (8739) | | |
| Notes Section | | |
| >99.99% reduction | 24 hr | 4.7 Log10 Reduction |
| Sample #2 SBSC Untreated Control<br>Inoculum: *S. aureus* (6538) | | |
| Notes Section | | |
| | 0 hr | 3340000 CFU/ml |
| | 24 hr | 1.03E+07 CFU/ml |
| Inoculum: *E. coli* (8739) | | |
| Notes Section | | |
| | 0 hr | 1320000 CFU/ml |
| | 24 hr | 1.29E+07 CFU/ml |

Table 1 shows results of the ISO-22196 test method to measure the antimicrobial properties of solid or hard surface treated test samples incubated with selected microorganisms. The microorganisms used herein comprise *S. aureus* and *E. coli*. In this test method, the bacterial inoculum is in contact with the test sample for a duration of 24 hours without drying of the inoculum. Following this exposure, the inoculated bacteria are recovered, and the concentration of the organisms is determined. The antimicrobial performance is determined by comparison of the recovered organisms from the untreated material and treated material after the 24 hour incubation. The antimicrobial performance is reported as both the Log 10 and % Reduction relative to the untreated control sample. Table 1 shows that the 'Sud Scrub' sample resulted in a 4.3 log 10 reduction of *S. aureus* after 24 hours (i.e., 99.99% reduction) while the untreated control sample increased from 3,340,000 CFU/ml of *S. aureus* at 0 hrs to 1.03E+07 CFU/ml at 24 hrs of *S. aureus*. Further, the 'Sud Scrub' sample resulted in a 4.7 log 10 reduction of *E. coli* after 24 hours (i.e., >99.99%) while the untreated control sample increased from 1,320,000 CFU/ml of *E. coli* at 0 hrs to 1.29E+07 CFU/ml *E. coli* at 24 hrs.

Example 2

Resistance of Synthetic Polymeric Materials to Fungi

Method Conventions

The ASTM G21 is a qualitative antimicrobial test used to detect general fungistatic activity on materials. Test results are reported based on a rating scale of 0 to 4 and test notes are provided if a zone of inhibition or contact inhibition is present.

Fungal growth rating:

0—no fungal growth

1—trace growth (<10% coverage)

2—light growth (10% to 30% coverage)

3—medium growth (30% to 60% coverage)

4—heavy growth (~60% to complete coverage)

Note: score "1" is also applicable to trace of growth from extraneous contamination. Non-test organisms are included in the final score; note section will indicate if non-inoculum fungi are present.

Introduction

The ASTM G21 method provides an assessment for fungal resistance of a test material. The test sample is placed onto a nutrient-salt agar and inoculated with a mixed fungal spore inoculum. The inoculum consists of spores derived from *A. brasiliensis, P. funiculosum, C. globosum, T. virens*, and *A. pullulans* fungi. Test samples are incubated at 28 C and greater than 90% relative humidity for 28 days. After the incubation period, test samples are visually evaluated for presence and extend of fungal growth. The test result score is based on rating provided by the test method.

Samples are evaluated and assigned a score according to the method scoring scheme. A grid-scale is used to estimate the percent coverage of the test sample based on the microscopic observation using a stereomicroscope.

Test Procedure

Test (FIGS. 16A and 16B) and control (FIG. 16C) samples are placed onto nutrient-salts agar and sprayed with a mixed fungal spore suspension. It is applied thoroughly cover the sample surface with droplets from the mist spray on the sample surface and to inoculate the media component of the sample plate. Each fungal culture is created with a spore concentration of approximately 1E6 spore/ml. The standard test duration is 28 days unless indicated otherwise. The standard test environmental conditions are 28+/−2 C and >90% relative humidity.

Reagent List: Glass distilled, de-ionized water, Nutrient-salts media.

Equipment List: incubators, stainless steel ruler, temperature logger, hygrometer, stereomicroscope, scoring grid, camera, pipettes.

Test Organisms and Inventor ID/Lot #:_Aureobasidium *pullulans* (15233), *Trichoderma virens* (9645), *Penicillium funiculosum* (11797), *Aspergillus brasiliensis* (9642), *Chaetomium globosum* (6205)

Sample Preparation

Standard sample preparation procedure is for 4.8+/−0.1 cm circular samples (FIGS. 16A and 16B) to be cut and for triplicate items to be tested.

Sampling Procedure

Unless specified, samples are cute from provided pieces or used as received if precut. Unless specified, the sample provided is treated as uniform, and monolithic for the purposes of testing.

Table 2 shows Measurement of Material's Resistance to Fungi

TABLE 2

| Test Method ASTM G21-Standard Practice for Determining Resistance of Synthetic Polymeric Materials to Fungi | | |
|---|---|---|
| | Interval | Result |
| Sample #1 Sudscrub Inoculum: Mixed Fungi: ASTM G21) | | |
| Notes Section | | |
| <30% Coverage by fungal mycelia and spore | 28 day | 2 0 to 4 (4 is poor) |
| Sample #2 SBSC Untreated Control Inoculum: Mixed Fungi: ASTM G21) | | |
| Notes Section | | |
| <90% Full and even coverage by fungal mycelia and spore | 28 day | 4 0 to 4 (4 is poor) |

Table 2 shows results of the ASTM G21 standard practice for determining resistance of synthetic polymeric materials to fungi. The ASTM G21 is a qualitative antimicrobial test used to detect general fungistatic activity on materials. The test results are reported based on a rating scale of 0 to 4 and test notes are provided if a zone of inhibition or contact inhibition is present. Fungal growth rating in these results is as follows: 0—no fungal growth, 1—Trace growth (<10% coverage), 2—Light growth (10% to 30% coverage), 3—Medium growth (30% to 60% coverage), and 4—Heavy growth (~60% to complete coverage). The 'Sud Scrub' sample and an Untreated Control sample were inoculated with spores derived from: *A. brasiliensis, P. funiculosum, C. globosum, T. virens*, and *A. pullulans* fungi. After 28 days, the 'Sud Scrub' sample resulted in a score of 2 while the Untreated Control resulted in a score of 4. It was noted that the 'Sudscrub' sample had <30% coverage by fungal mycelia and spore while the Untreated Control sample had >90% full and even coverage by fungal mycelia and spore.

Figure 16A:
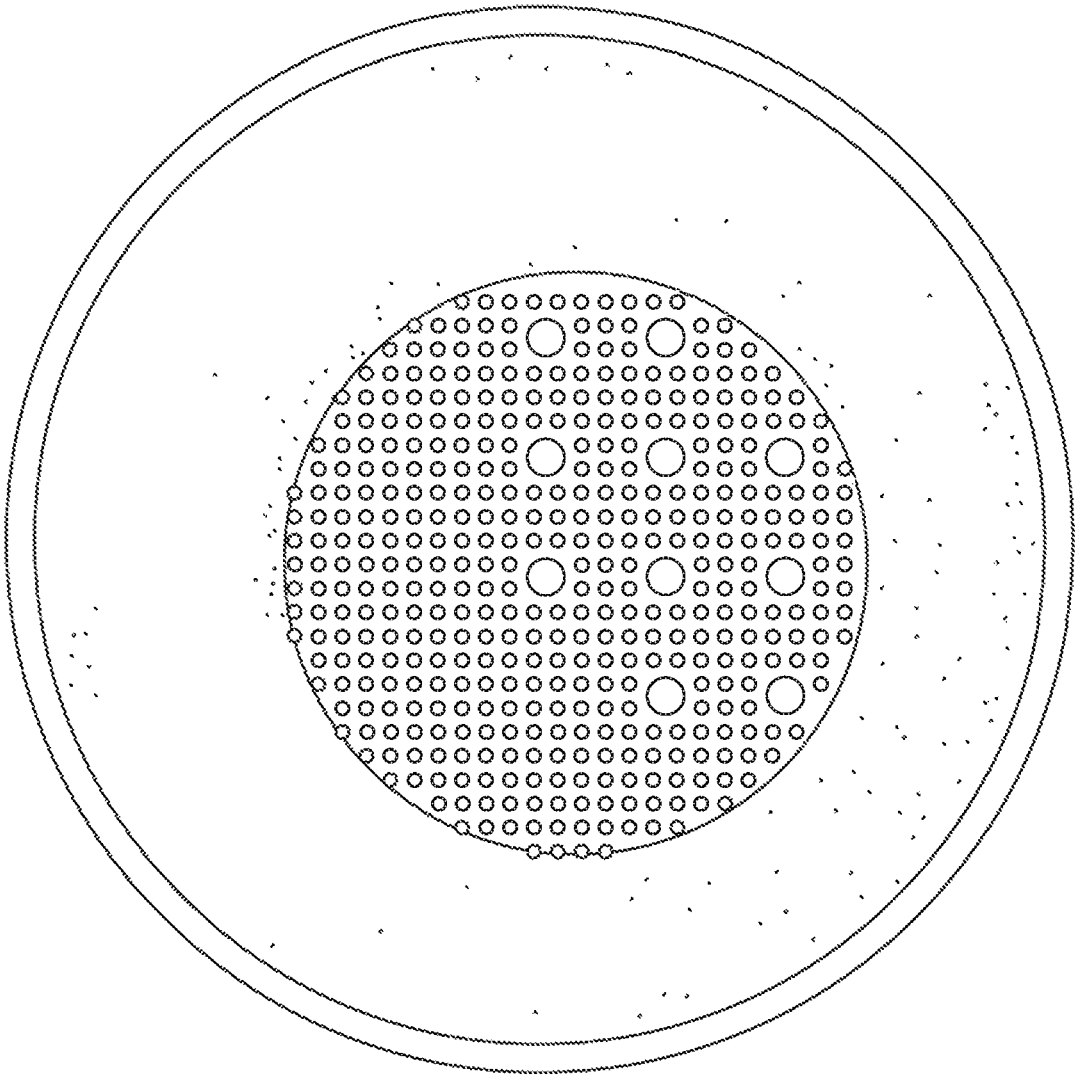
FIGS. 16A-16C shows non-limiting, exemplary results of a standard practice (ASTM G21) for determining resistance of synthetic polymeric materials to fungi.
Figure 16B:
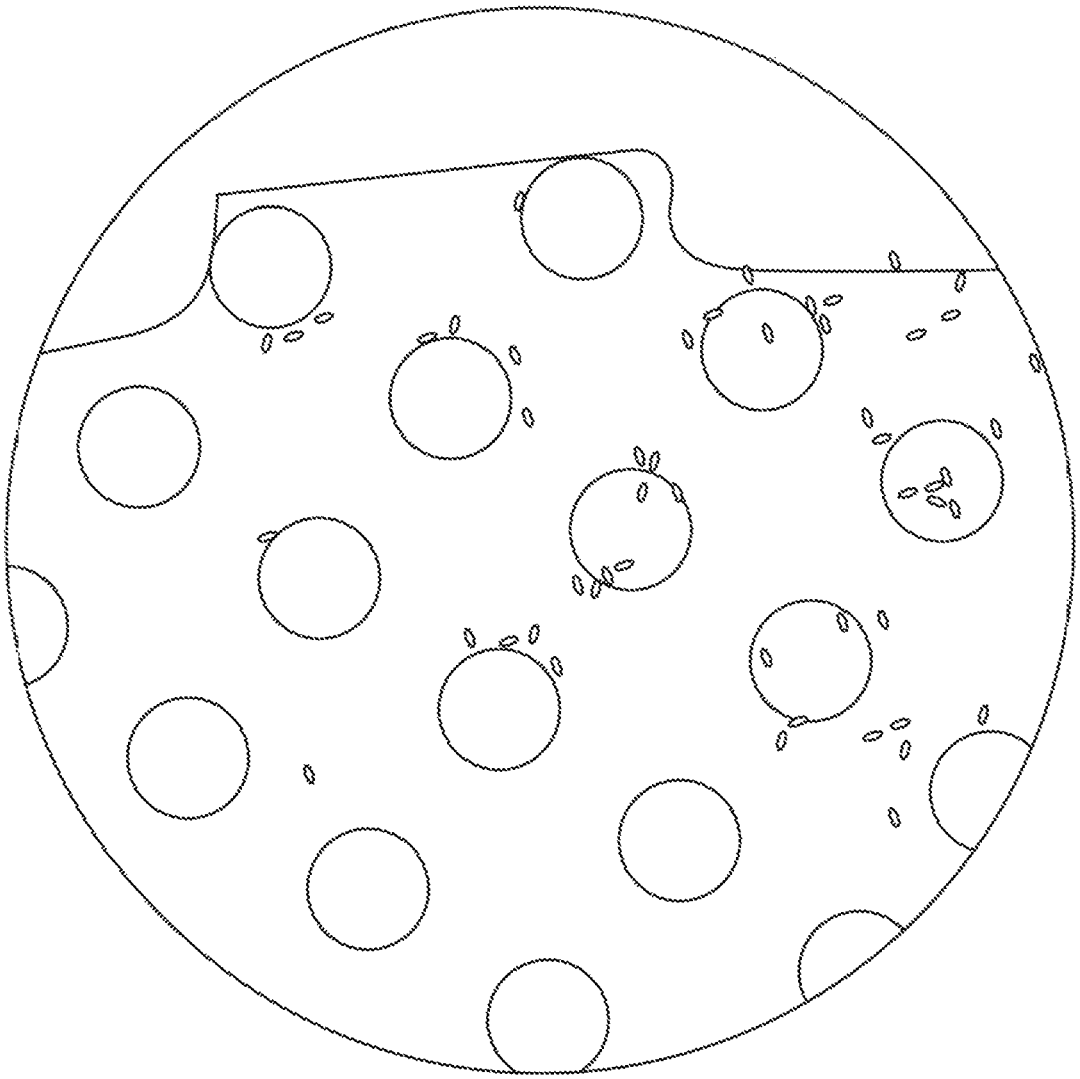
Figure 16C:
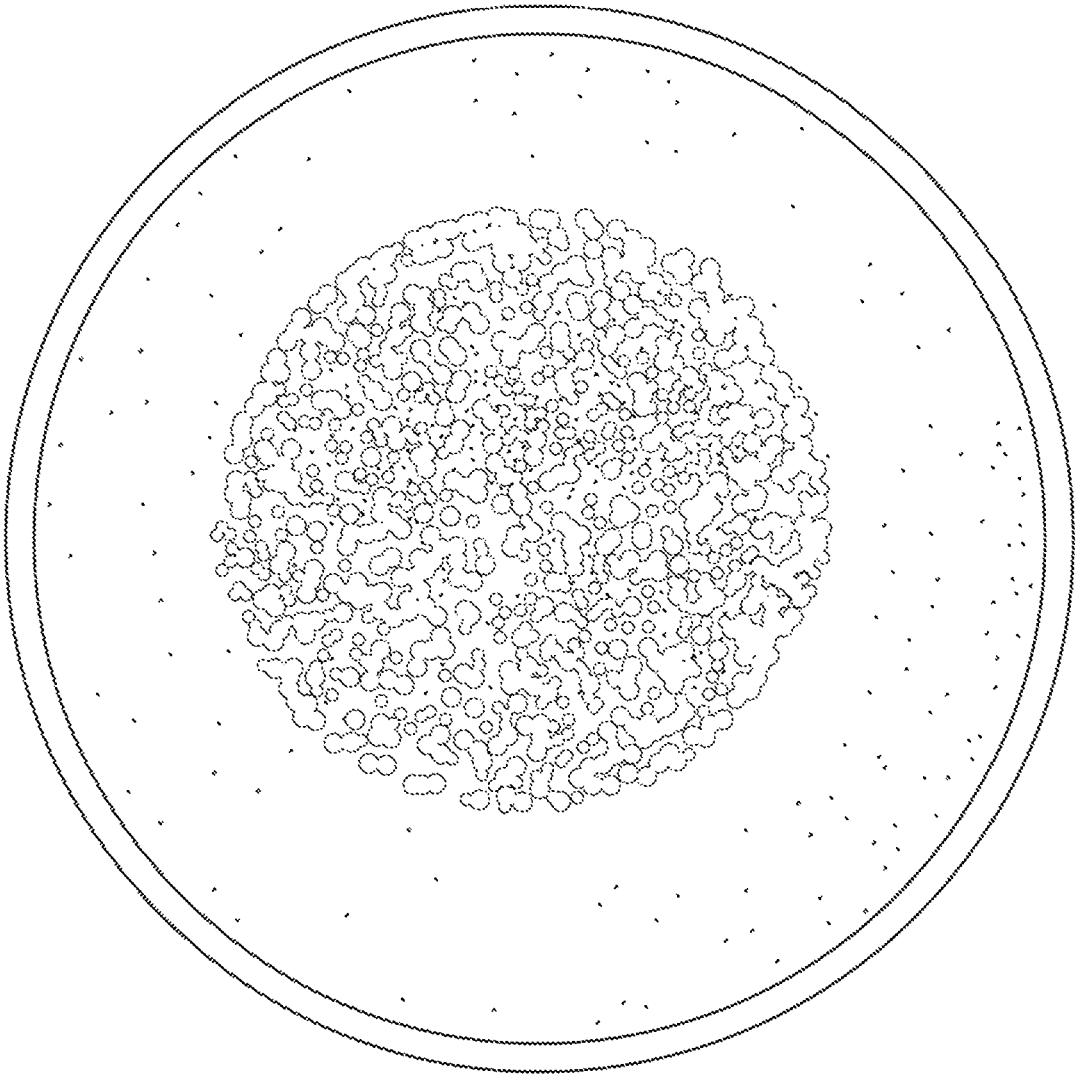
Figure 17:
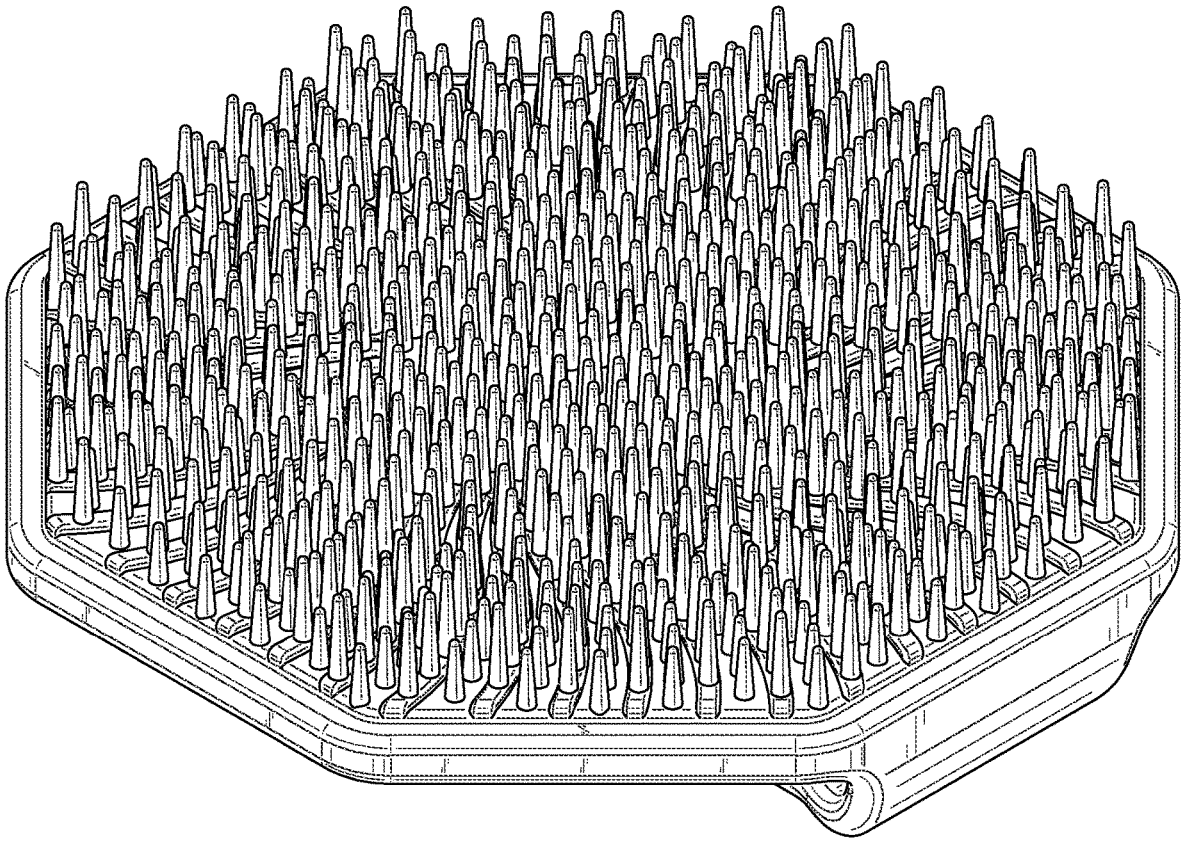
FIG. 17 shows a top perspective view of a Facial Scrubbing Device.
Figure 18:
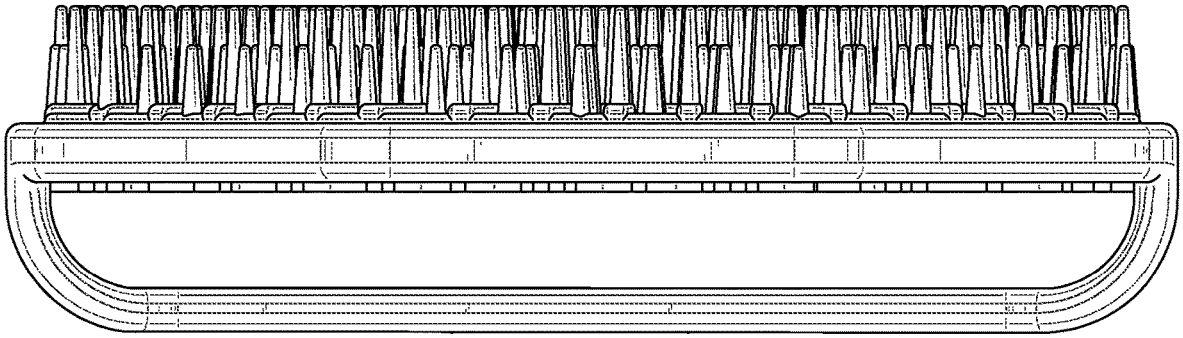
FIG. 18 shows a left view of a Facial Scrubbing Device.
Figure 19:
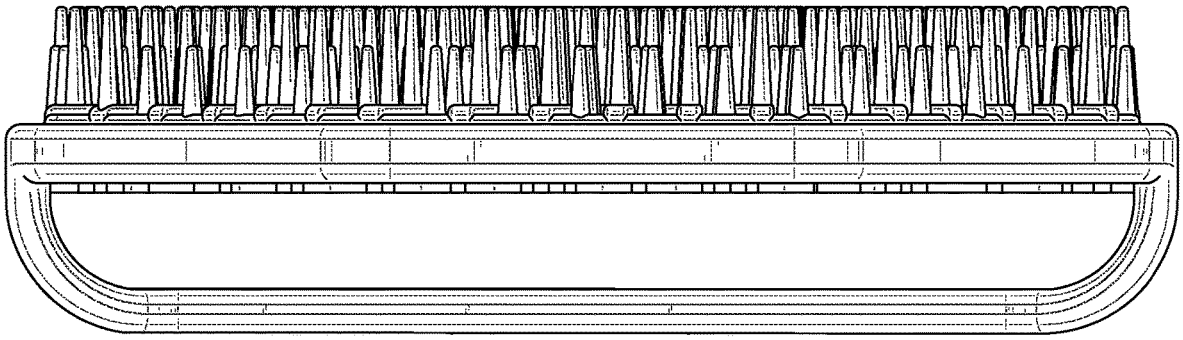
FIG. 19 shows a right view of a Facial Scrubbing Device.
Figure 20:
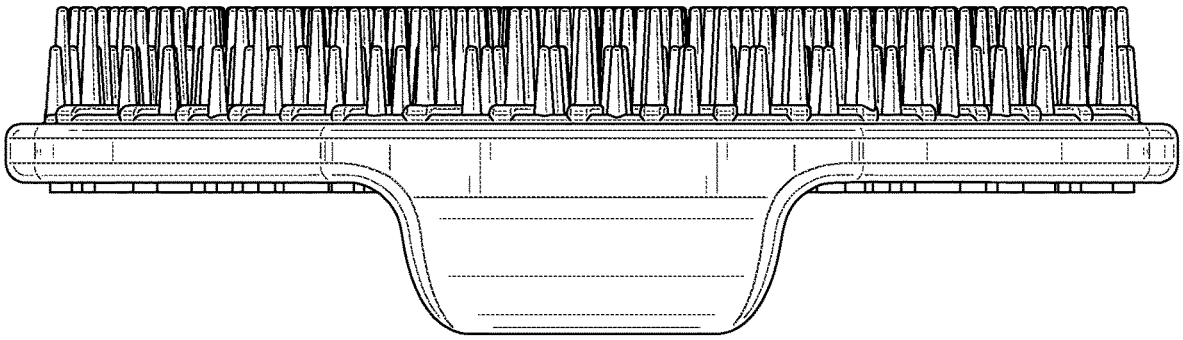
FIG. 20 shows a front view of a Facial Scrubbing Device.
Figure 21:
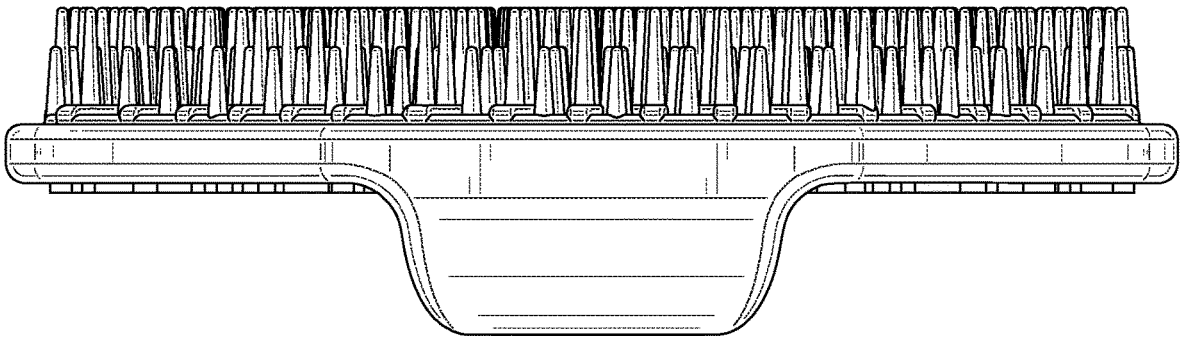
FIG. 21 shows a rear view of a Facial Scrubbing Device.
Figure 22:
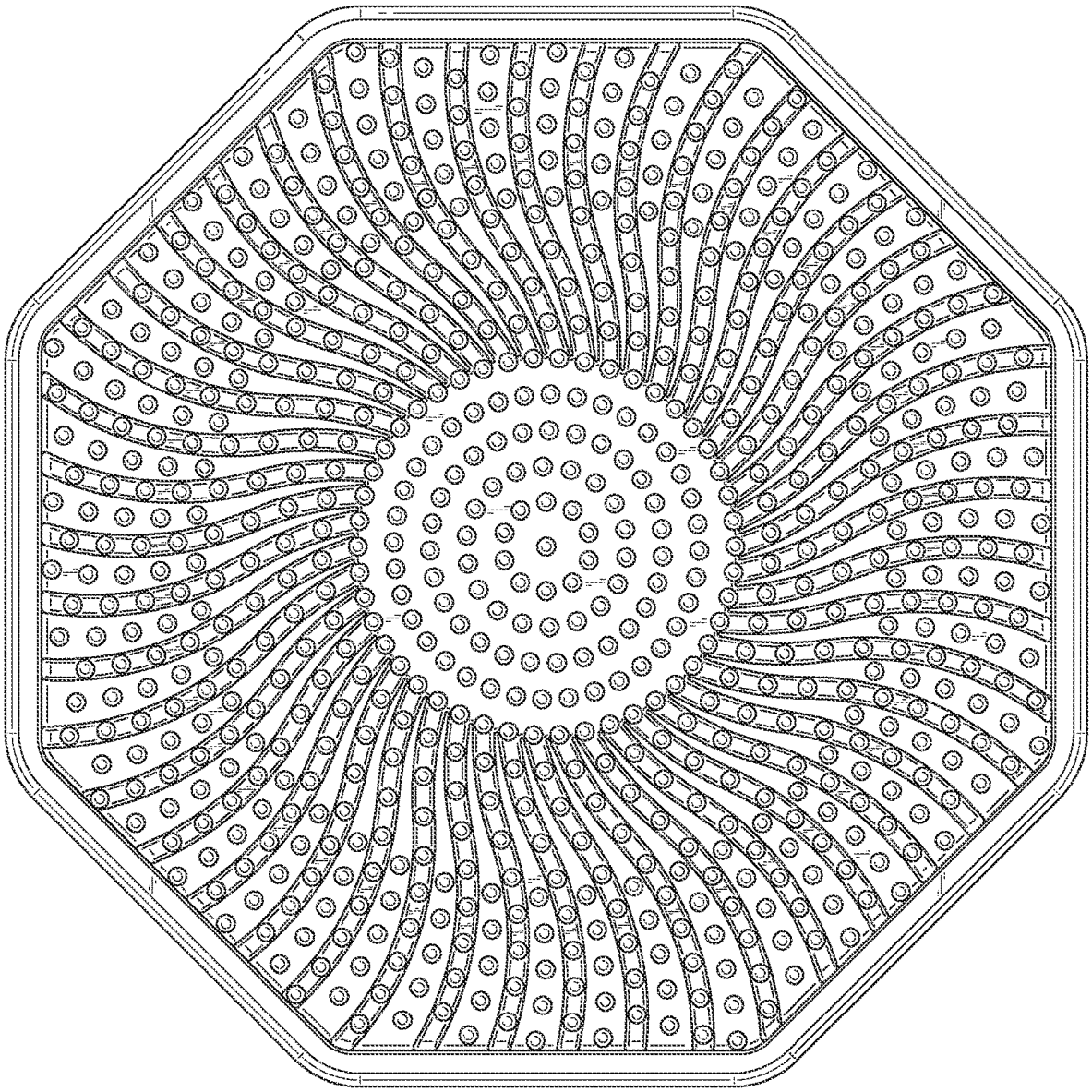
FIG. 22 shows a top view of a Facial Scrubbing Device.
Figure 23:
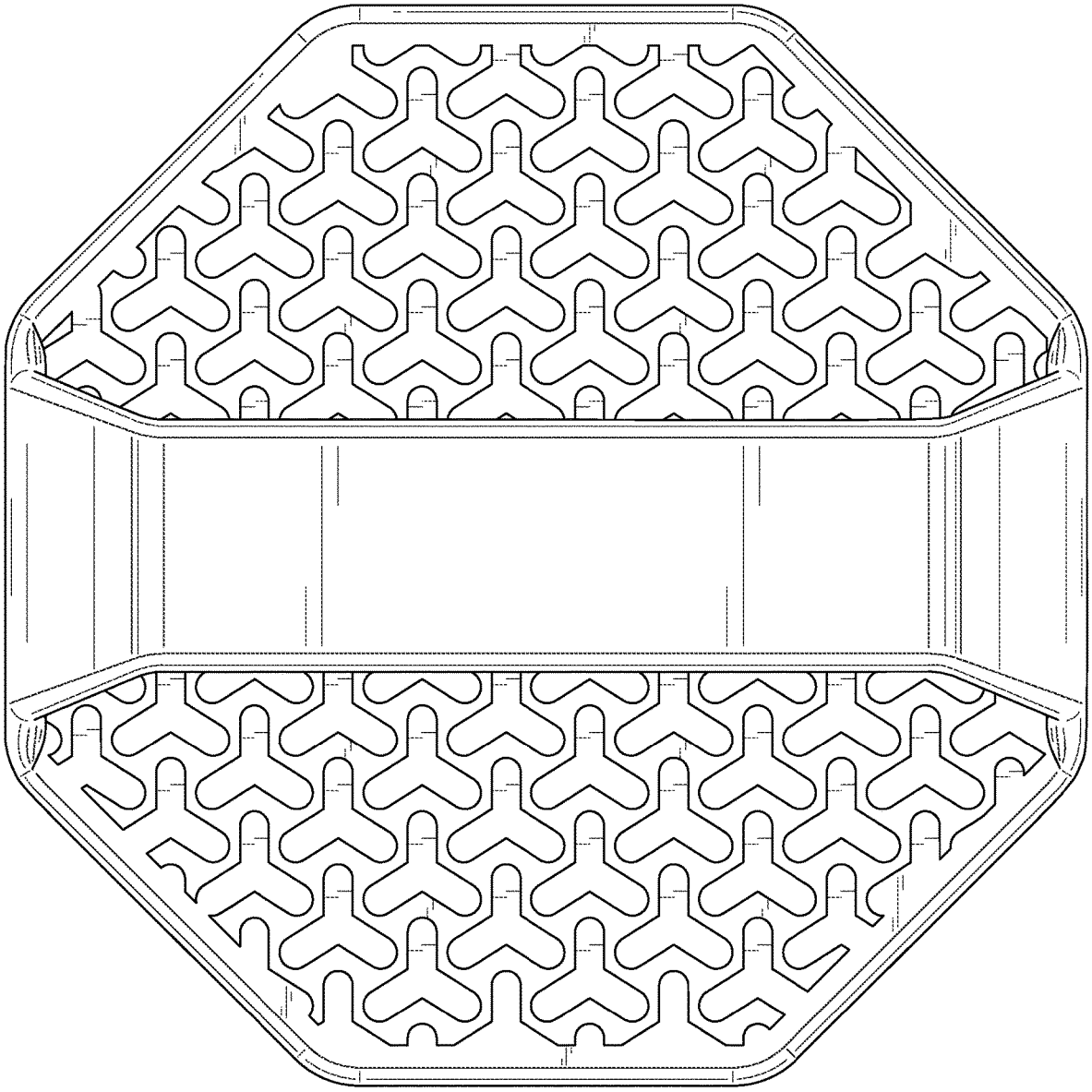
FIG. 23 shows a bottom view of a Facial Scrubbing Device.
Figure 24:
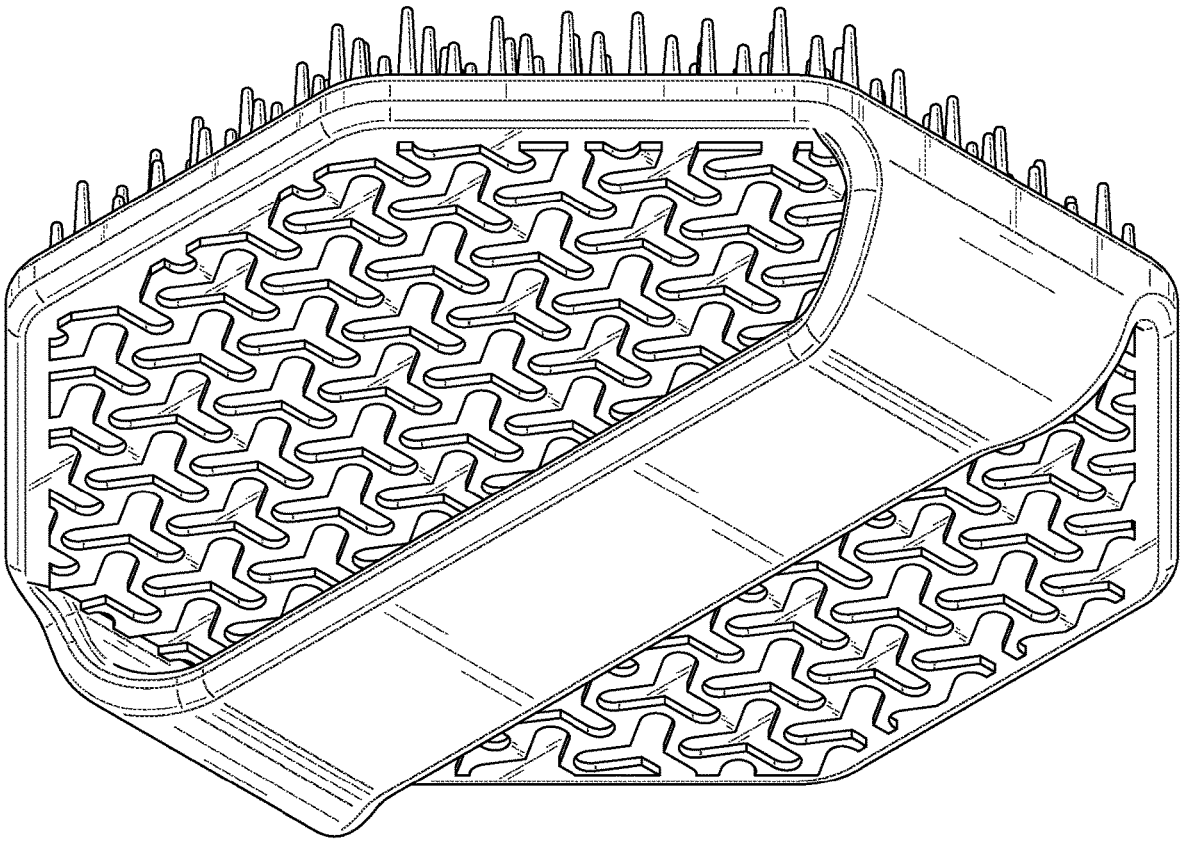
FIG. 24 shows a bottom perspective view of a Facial Scrubbing Device.

FIGS. 16A-16C show non-limiting, exemplary results of a standard practice (ASTM G21) for determining resistance of synthetic polymeric materials to fungi. FIG. 16A shows the 'Sudscrub' sample at the 28 day timepoint after inoculation with mixed fungi. FIG. 16B shows a microcopy image of the circular samples extracted from the 'Sudscrub' sample of FIG. 16A. FIG. 16C shows the untreated control at the 28 day timepoint after inoculation with the mixed fungi.

Example 3

A device is described herein comprising a central body, a plurality of dividers, and a handle. The central body comprises a first surface and a second surface. Each divider of the plurality of dividers extends upwardly from the first surface of the central body, wherein each divider of the plurality of dividers extends radially from an interior of the first surface to a periphery of the first surface. A handle is attached to the central body.

Each divider of the plurality of dividers follows a first curved pathway along a first section of the divider, under an embodiment.

Each divider of the plurality of dividers follows a second curved pathway along a second section of the divider, under an embodiment.

The first curved pathway comprises a first radius of curvature, wherein the second curved pathway comprises a second radius of curvature, under an embodiment.

The first radius of curvature is equal to the second radius of curvature, under an embodiment.

The plurality of dividers of an embodiment comprises a first set of dividers and a second set of dividers.

The dividers of the first set comprise a first height, wherein dividers of the second set comprise a second height, under an embodiment.

The first height is different than the second height, under an embodiment.

The first set of dividers radially extend from a first reference boundary of the interior, wherein the first reference boundary comprises a circle, under an embodiment.

The second set of dividers radially extend from a second reference boundary of the interior, wherein the second reference boundary comprises a circle, under an embodiment.

A circumference of the first reference boundary is smaller than a circumference of the second reference boundary, under an embodiment.

The radially extending plurality of dividers alternate between dividers of the first set and dividers of the second set under, an embodiment.

An upper edge of each divider comprises a plurality of ridges extending from the upper edge, under an embodiment.

Each ridge of the plurality of ridges comprises a height of 2.5 mm and a width of 1.35 mm, under an embodiment.

The periphery of the central body comprises a wall surrounding the first surface, under an embodiment.

The wall comprises a height of 10.00 mm under an embodiment.

The wall comprises a polygon, under an embodiment. The device can form a gap (e.g., a gap 184 in FIGS. 6 and 7) between a side of the polygon of the outermost edge and a portion of the wall that surrounds the periphery of the central body.

The handle attaches to a first side and a second side of the wall, wherein the first side and second side are located on opposing sides of the wall, under an embodiment.

The plurality of dividers, the central body, and the handle are integrally formed and entirely flexible, under an embodiment.

The device comprises silicone, under an embodiment.

An infusement is infused into the silicone, under an embodiment.

The infusement is infused into the silicone at a concentration of about 20-30 g/kg, under an embodiment.

The infusement comprises silver phosphate, pyrithione zinc, or a combination thereof, under an embodiment.

The infusement further comprises a filler, under an embodiment.

The silver phosphate, pyrithione zinc, or combination thereof comprises about 90% of the infusement and the filler comprises about 10% of the infusement, under an embodiment.

The infusement comprises about 15 g/kg of silver phosphate and about 15 g/kg of pyrithione zinc, under an embodiment.

The 15 g/kg of silver phosphate comprises about 10% filler, under an embodiment.

EQUIVALENTS

Those skilled in the art will recognize, or be able to ascertain, using no more than routine experimentation, numerous equivalents to the specific substances and procedures described herein. Such equivalents are considered to be within the scope of this invention and are covered by the following claims.

What is claimed is:

1. A scrubber device comprising:

a central body including:

a first flat surface on a first side of the central body; and a second flat surface on a second opposing side of the central body; and a first array of bristles and a second array of bristles that extend away from the first surface on the first side of the central body, wherein the first and second array of bristles is arranged in wave-shaped pathways extending radially from a first end of the pathways at an interior of the central body toward a second end of the pathways at a periphery of the central body, wherein at least one of the first or second arrays has a raised base from the first flat surface, wherein the raised base connects the bristles in the array, wherein the first array of bristles comprises a first set of bristles and the second array of bristles comprises a second set of bristles, wherein the first set of bristles extends a first height away from the first surface on the first side, wherein the second set of bristles extends a second height away from the first surface on the first side, wherein the first height is greater than the second height, and wherein the first and second arrays of bristles alternates between the first array of bristles and the second array of bristles.

2. The scrubber device of claim 1, further comprising:

a strap connected to the central body, wherein the strap extends across at least a portion of the second side of the central body, and wherein the scrubber device is configured to receive a palm of a hand of a user on the second surface of the second side of the central body and secure the hand between the second surface and the strap.

3. The scrubber device of claim 1, wherein each wave-shaped pathway of the first and second arrays of bristles has a first curvature along a first section of the wave-shaped pathway, wherein each wave-shaped pathway of the first and second arrays of bristles has a second curvature along a second section of the wave-shaped pathway, and wherein the first curvature is different from the second curvature.

4. The scrubber device of claim 3, wherein the first curvature is equal to and opposite facing of the second curvature.

5. The scrubber device of claim 1, wherein the raised base of the first or second array of bristles further comprises a first raised base and a second raised base, the first array of bristles having the first raised base and the second array of bristles having the second raised base, the first raised base having a third height, and the second raised base having a fourth height different than the third height.

6. The scrubber device of claim 5, wherein the first array of bristles and the second array of bristles extend from the respective upper edges of the first raised base and the second raised base by a length that is less than a difference between the first height and the second height.

7. The scrubber device of claim 1, wherein the raised base extends from the first surface of the central body by a fifth distance, wherein the first array of bristles has the raised base, and wherein the second array of bristles extend from the first surface of the central body.

8. The scrubber device of claim 7, wherein the first set of bristles extends from upper edges of the raised base by a length that is greater than the fifth distance.

9. The scrubber device of claim 1, wherein the scrubber device has a unitary structure that is entirely flexible.

10. The scrubber device of claim 1, wherein the first array of bristles is arranged in the wave-shaped pathways extending radially from a first reference circle at the interior of the central body toward the second end of the pathways at the periphery of the central body, wherein the scrubber device further comprises a third array of bristles positioned within the first reference circle at the interior of the central body, and wherein the third array of bristles is arranged in a circular pattern.

11. The scrubber device of claim 1, wherein an outermost edge of the scrubber device forms a polygon, wherein the scrubber device further comprises a strap connected to the central body, and wherein the strap extends between opposite sides of the polygon so that the strap extends across at least a portion of the second side of the central body.

12. The scrubber device of claim 1, wherein the scrubber device has a unitary structure made of silicone, wherein the unitary structure is infused with an antimicrobial agent, and wherein, due to having the unitary structure made of silicone infused with an antimicrobial agent, the scrubber device is more durable and has a greater use-time than conventional bath and shower devices made of a porous network of fibers, thereby mitigating climate change.

13. A scrubber device comprising:

a central body including:

a first flat surface on a first side of the central body; and a second flat surface on a second opposing side of the central body;

a strap connected to the central body, wherein the strap extends across at least a portion of the second side of the central body, and wherein the scrubber device is configured to receive a palm of a hand of a user on the second surface of the second side of the central body and secure the hand between the second surface and the strap;

a first array of scrubbing features and a second array of scrubbing features that extend away from the first surface on the first side of the central body, wherein the first and second array of scrubbing features is arranged in wave-shaped pathways extending radially from a first end of the pathways at an interior of the central body toward a second end of the pathways at a periphery of the central body, wherein at least one of the first or second arrays has a raised base from the first flat surface, wherein the raised base connects the scrubbing features in the array, wherein the first array of scrubbing features comprises a first set of scrubbing features and the second array of scrubbing features comprises a second set of scrubbing features, wherein the first set of scrubbing features extends a first height away from the first surface on the first side, wherein the second set of scrubbing features extends a second height away from the first surface on the first side, wherein the first height is greater than the second height, and wherein the first and second arrays of scrubbing features alternates between the first array of scrubbing features and the second array of scrubbing features.

14. The scrubber device of claim 13, wherein each wave-shaped pathway of the first and second arrays of scrubbing features has a first curvature along a first section of the wave-shaped pathway, wherein each wave-shaped pathway of the array of scrubbing features has a second curvature along a second section of the wave-shaped pathway, and wherein the first curvature is different from the second curvature.

15. The scrubber device of claim 13:

wherein the raised base of the first or second array of scrubbing features further comprises a first raised base and a second raised base, the first raised base having a third height, and the second raised base having a fourth height different than the third height.

16. The scrubber device of claim 13, wherein the raised base extends from the first surface of the central body by a fifth distance, wherein the first array of scrubbing features has the raised base, and wherein the second array of scrubbing features extend from the first surface of the central body.

17. A scrubber device comprising:

a central body including:

a first flat surface on a first side of the central body; and a second flat surface on a second opposing side of the central body;

a first array of scrubbing features and a second array of scrubbing features that extend away from the first surface on the first side of the central body, wherein the first and second array of scrubbing features is arranged in wave-shaped pathways extending radially from a first end of the pathways at an interior of the central body toward a second end of the pathways at a periphery of the central body, wherein at least one of the first or second arrays has a raised base from the first flat surface, wherein the raised base connects the scrubbing features in the array, wherein the first array of scrubbing features comprises a first set of scrubbing features and the second array of scrubbing features comprises a second set of scrubbing features, wherein the first set of scrubbing features extends a first height away from the first surface on the first side, wherein the second set of scrubbing features extends a second height away from the first surface on the first side, wherein the first height is greater than the second height, and wherein the first and second arrays of scrubbing features alternates between the first array of scrubbing features and the second array of scrubbing features.

18. The scrubber device of claim 17, further comprising:

a strap connected to the central body, wherein the strap extends across at least a portion of the second side of the central body.

19. The scrubber device of claim 17, wherein each wave-shaped pathway of the first and second array of scrubbing features has a first curvature along a first section of the wave-shaped pathway, wherein each wave-shaped pathway of the array of scrubbing features has a second curvature along a second section of the wave-shaped pathway, and wherein the first curvature is different from the second curvature.

20. The scrubber device of claim 17, wherein the raised base of the first or second array of scrubbing features further comprises a first raised base and a second raised base, the first raised base having a third height; and the second raised base having a fourth height different than the third height.

* * * * *